United States Patent [19]

Maruyama

[11] Patent Number: 4,544,337

[45] Date of Patent: Oct. 1, 1985

[54] ROTARY COMPRESSOR WITH TWO OR MORE SUCTION PARTS

[76] Inventor: Teruo Maruyama, 18-40, Nagisaminamimachi, Hirakata-shi, Osaka 573, Japan

[21] Appl. No.: 522,366

[22] PCT Filed: Nov. 10, 1982

[86] PCT No.: PCT/JP82/00436

§ 371 Date: Jul. 11, 1983

§ 102(e) Date: Jul. 11, 1983

[87] PCT Pub. No.: WO83/01818

PCT Pub. Date: May 26, 1983

[30] Foreign Application Priority Data

Nov. 11, 1981 [JP] Japan ..... 56-180814
Feb. 24, 1982 [JP] Japan ..... 57-29719

[51] Int. Cl.[4] ..... F04C 18/00; F04C 29/08
[52] U.S. Cl. ..... 418/15; 418/150
[58] Field of Search ..... 418/15, 150, 259

[56] References Cited

U.S. PATENT DOCUMENTS 3,199,771 8/1965 Becker ..... 418/15

FOREIGN PATENT DOCUMENTS 57-70986 5/1982 Japan .
133890 9/1929 Switzerland ..... 418/15
818691 8/1959 United Kingdom ..... 418/15

*Primary Examiner*—John J. Vrablik
*Attorney, Agent, or Firm*—Wenderoth, Lind & Ponack

[57] ABSTRACT

A compressor of the present invention performs restraining action in refrigerative ability at high speed driving time utilizing suction loss that vane chamber pressure drops lower than supply source pressure of refrigerant, and comprises a rotor (14) having vanes provided slidably, a cylinder (11) receiving said rotor (14) and vanes (12), side plates fixed to both side faces of said cylinder (11) and closing tightly a space of vane chamber (18*a*), (18*b*) formed by said vanes (12), rotor (14) and cylinder (11) at its side faces, and at least more than two suction ports (15) and (17), whereby even in a compressor having many numbers of vane (12), such a compressor with ability control that having no loss in refrigerative ability at low speed, and refrigerative ability is restrained only at high speed driving can be realized.

5 Claims, 42 Drawing Figures

| Compressor | Characteristics of suction method | Model of electric circuit |
|---|---|---|
| A | Refrigerant is supplied from suction port 101 to upstream side vane chamber 102 further is supplied to downstream side vane chamber 103 through suction groove 105. | 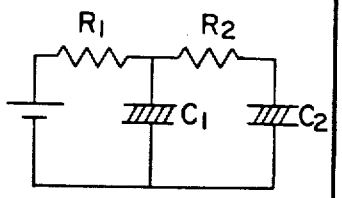  |
| B | Suction port 201 is formed in a side plate, and when a vane traverses the suction port, refrigerant is divided by the vane and supplied to upper vane chamber 203 and lower vane chamber 204. | 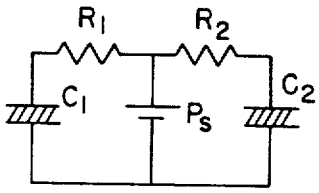  |
| C | This is constituted so that refrigerant is supplied from one suction port to only one vane chamber. (Construction of the present invention or Japanese Patent application No. Sho 55-134048). | 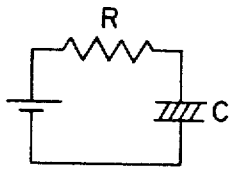  |

ROTARY COMPRESSOR WITH TWO OR MORE SUCTION PARTS

TECHNICAL FIELD

The present invention relates to a compressor in which limiting of refrigerative capacity at high speed operation is performed utilizing suction loss brought about by loss of vane chamber pressure during the suction stroke which drops below the supply source pressure of refrigerant.

BACKGROUND ART

In general a sliding vane type compressor comprises, as shown in FIG. 1, a cylinder 1 having interior cylindrical space, side plates (not shown in FIG. 1) which are fixed to both side faces of the cylinder and close tightly a vane chamber 2 in the interior space of the cylinder at its side faces, a rotor 3 arranged eccentrically within the cylinder 1, and vanes 5 engaged slidably in grooves 54 provided on the rotor 3. Further, reference numeral 6 designates a suction port formed in the side plate, and 7 designates a discharge hole formed in cylinder 1. The vanes 5 move outwardly due to centrifugal force upon rotation of the rotor 3, and the end edges slide on the interior wall surface of cylinder 1, thereby to prevent passage of gas in the compressor thereby.

In a rotary compressor such as a sliding vane type, a small and simple structure is possible compared with the reciprocating type compressor which is complex in its structure and which has many parts, so it has recently come to be used as an automobile refrigerant compressor. However, in this rotary type compressor, there are such problems as described hereinafter compared with the reciprocating type.

In the case of the automobile refrigerant compressor, the driving force of the automobile engine is transmitted to a pulley of a clutch through a belt, and it drives a rotary shaft of the compressor. Accordingly, when the sliding vane type compressor is used, its compression action rises in a proportion to the rotational speed of the engine of the automobile.

On the other hand, when a conventional reciprocating type comporessor has been used, the follow-up property of the suction valve becomes bad in the high rotational speed range, and gas to be compressed cannot be sucked fully into the cylinder, and as the result, compression of refrigerant is automatically reduced in the high rotational speed range, while in the rotary type compressor, there is no such action, and compression efficiency is decreased due to increasing compression work, or it reaches an over-cooling state. As a method to overcome the aforesaid problems in the rotary compressor, it has been proposed to provide a control valve to vary the cross-sectional area of the intake passage communicated with the suction port 6 of the rotary compressor, and control is performed by throttling the area in the high speed range and utilizing the suction loss. However, in this case, there is a problem that such a control valve must be added to the existing apparatus, which makes the construction become complex and the cost high. As another method to overcome over-compression of the rotary compressor in the high speed range, there has been proposed hitherto a construction in which the rotational speed is not increased over a certain value by using a fluid clutch, planetary gears, etc.

However, in the former arrangement, energy loss due to frictional heat generated by relatively moving faces is large, and in the latter arrangement the dimensions and shape of the apparatus become large due to the addition of the planetary gear mechanism having a large number of parts, whereby both arrangements are difficult to utilize practically where simplification and compactness are increasingly required and the trend toward energy-saving is increasing.

The present inventors have investigated in detail the phenomena of pressure in the vane chamber when the rotary compressor is used in order to overcome the problems in the refrigeration cycle of an air conditioner for a motor vehicle, and as a result, it has been found that self-restraining action of the refrigeration capacity in the high speed rotation range can be effectively achieved for a rotary compressor, similarly to the conventional reciprocating compressor, by selecting and combining parameters such as the area of the suction port, quantity of refrigerant discharged, the number of vanes, etc.

The present invention relates to improvements in rotary compressor, and it provides a fundamental construction of a compressor which provides the ability control the compressing function more effectively in a compressor having many vanes (e.g. three-vanes or four-vanes).

In order to provide small torque variation in a compressor due to pulsations caused by the flow of discharged refrigerant and to attain a good operating feeling, a compressor having many vanes is preferable.

In a refrigeration cycle for a large car, a compressor having a large discharge capacity is required, and for a compressor having high reliability and no excessive over-compression pressure in the range of high speed rotation, such as more than 5000 rpm, it is better to have a larger number of vanes because the quantity of refrigerant discharged per vane chamber becomes small.

On the other hand, in the control of a compressor having many vanes, there is a problem that refrigerant in two or more vane chambers positioned before and behind a given vane interferes mutually during a suction stroke, so that full control of the compressive ability cannot be achieved.

Disclosure of the Invention

The present invention provides a fundamental contruction to control compression in a rotary compressor which overcomes said problems, and which has succeeded in gaining control equivalent to that obtainable in, e.g. a two van type compressor, by providing at least two suction ports so that refrigerant flowing into an individual vane chamber is supplied from each suction port independently.

BRIEF DESCRIPTION OF THE DRAWINGS

FIG. 4(*b*) is a graph showing volume efficiency relative to speed of rotation;

DETAILED DESCRIPTION OF THE PRESENT INVENTION

The present invention will be explained in the following order of themes by reference to its embodiments.

I. Explanation of the fundamental constitution and effect.

II. Analytic results of suction characteristics in a conventional compressor.

III. Explanation of the principle of this invention.

IV. Explanation of other embodiments.

I. Fundamental Constitution and Effect

Figure 1:
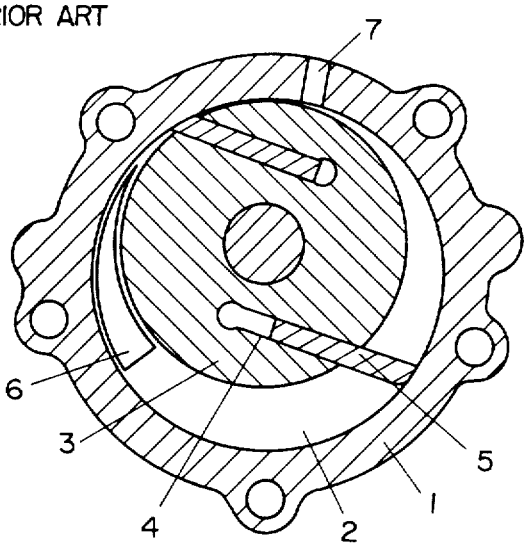
FIG. 1 PRIOR ART
FIG. 1 is a sectional view of conventional sliding vane type compressor.
Figure 2:
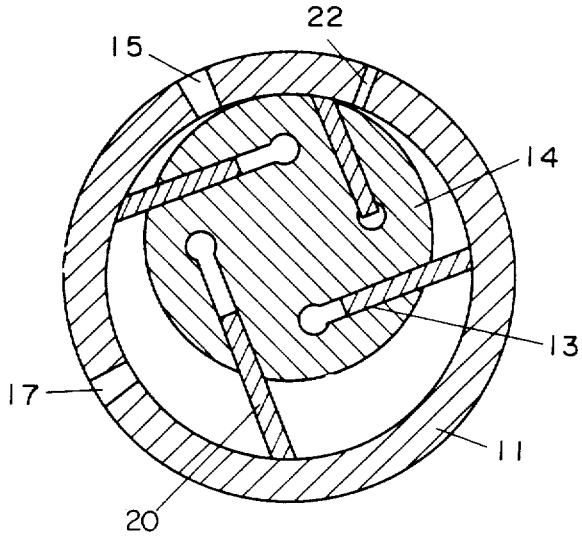
FIG. 2 is a sectional view of a four vane type compressor which is an embodiment of the present invention.

FIG. 2 is a front sectional view of compressor showing an embodiment of the present invention, constituted by a cylinder 11, vanes 20, sliding grooves 13 for the vanes, a rotor 14, a suction port 15, a suction port 17 spaced around cylinder 11 from port 15 in the direction of rotation of rotor 14 an angular distance equal to the angular spacing of vanes 20, and a discharging port 22. The interior of the cylinder 11 is closed tightly by side plates (not shown) at the side faces of the cylinder 11.

FIGS. 3(*a*)–(*e*) show the suction stroke of this compressor.

In FIG. 3, 18*a* designates a vane chamber behind 20*a*, 18*b* a vane chamber behind vane 20*b*, 18*c* a vane chamber behind vane 20*c*, and 19 a top part of cylinder 11. Considering the rotational angle ($\theta$) of the end of vane 20*a* around the rotational center (O) of rotor 14, and making $\theta=0$ when the end of the vane passes through the top part 19 of cylinder 11, and using said $\theta=0$ as an original point, and angle of the end of the vane at a given position is $\theta$. FIG. 3(*a*) shows the state at time just after vane 20*a* has passed top part 19.

FIG. 3(*b*) shows the state when vane 20*a* lies at an intermediate position between suction port 15 and suction port 17, and at this time, refrigerant is supplied into vane chamber 18*a* only from suction port 15.

FIG. 3(*c*) shows the state when vane 20*a* has passed suction port 17, and at the same time, vane 20*b* which follows vane 20*a* is passing suction port 15.

Thereafter supply of refrigerant from suction port 15 to vane chamber 18*a* is intercepted by vane 20*b*, and in place thereof supply from suction port 17 is started.

The effective cross-sectional area of suction port 15 is denoted by $a_1$, and the effective area of suction port 17 is donated by $a_2$, and this embodiment, suction port 17 has an effective area $a_2=a_1$.

Accordingly, in this embodiment, the effective area of the suction passage from the supply source of refrigerant to vane chamber 18*a* is always constant during the suction stroke.

FIG. 3(*d*) shows the state in which refrigerant is supplied vane chamber 18*a* from only suction port 17.

FIG. 3(*e*) shows the state at the time just after vane 20*b* has passed suction port 17, and such supply of refrigerant from suction port 17 is intercepted by vane 20*b*, the suction stroke is finished at this time.

In the usual four vane type compressor, $\theta=\theta_{s1}\approx 225°$, and the volume of the vane chamber 18*a* becomes maximum at this time.

As can be seen from the above explanation, in this embodiment, by the construction of the compressor in which two suction port 15 and 17 are provided, the vane chambers 18*a*, 18*b*, 18*c*, etc can suck in refrigerant from either of the two suction ports independently without mutual interference between the suction ports.

Accordingly, the inability to control the compression characteristics due to an increased number of vanes, has been improved in this embodiment, and superior ability to control the compression can be gained.

A compressor according to an embodiment of the present invention has been built with the following characteristics:

TABLE 1

| Parameter | Mark | Embodiment |
|---|---|---|
| Number of vanes | n | 4 |
| Effective area of suction port A | $a_1$ | 0.28 $cm^2$ |
| Effective area of suction port B | $a_2$ | 0.28 $cm^2$ |
| Diameter of rotor | $D_r$ | 56 mmR |
| Diameter of cylinder | $D_c$ | 66 mmR |

Figure 4A:
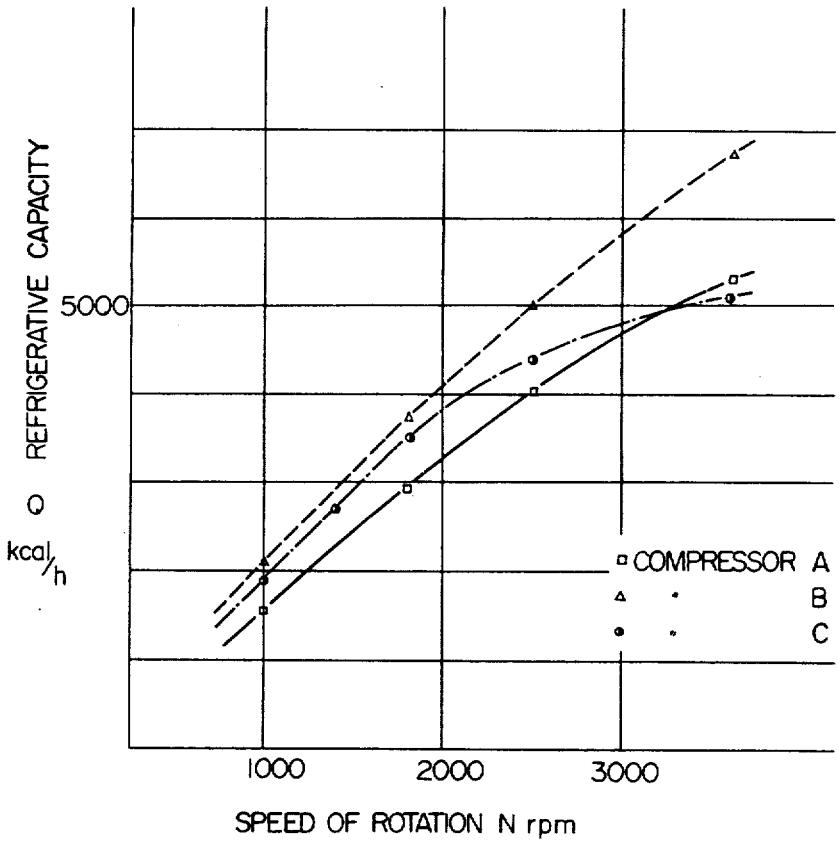
FIG. 4(*a*) is a graph showing refrigerative capacity relative to speed of rotation.
Figure 4B:
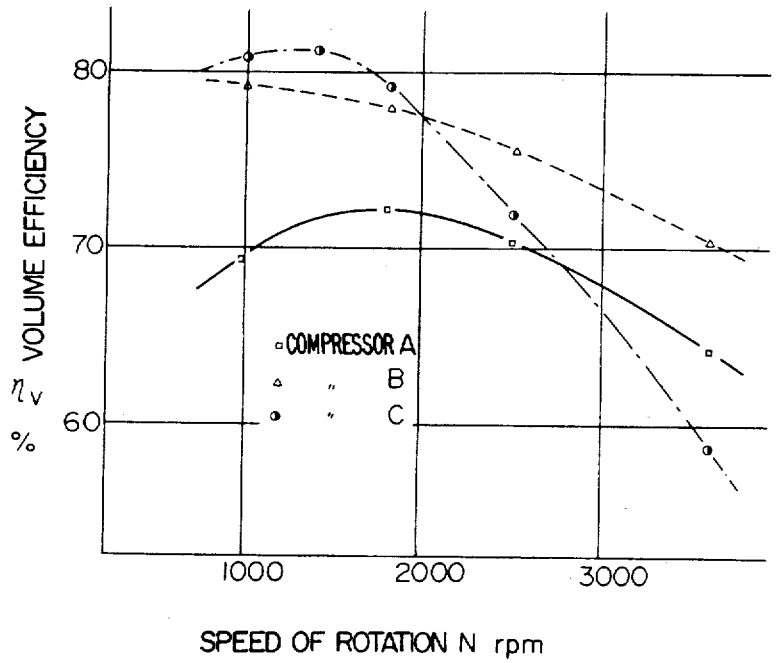
Figure 5A:
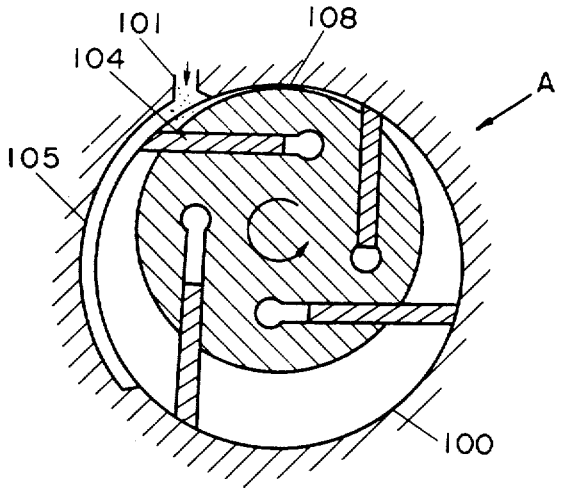
FIG. 5A PRIOR ART
FIGS. 5(*a*)–(*d*) are explanatory drawings showing the state of refrigerant flowing into each vane chamber during the suction stroke of a compressor A.
Figure 5B:
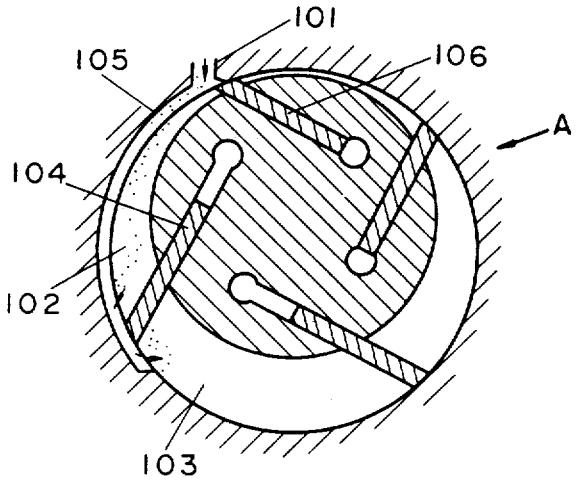
FIG. 5B PRIOR ART
Figure 5C:
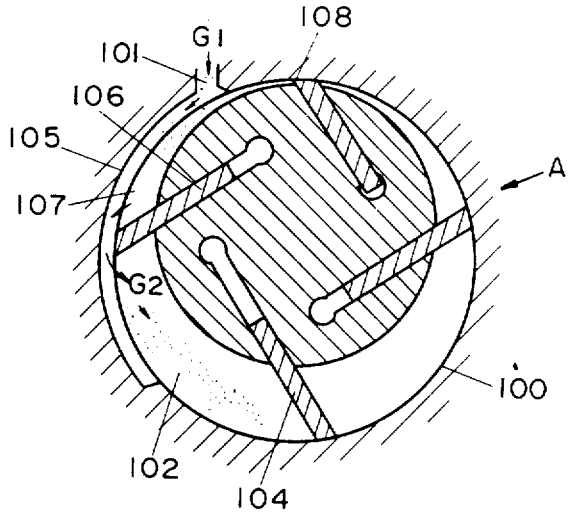
FIG. 5C PRIOR ART
Figure 5D:
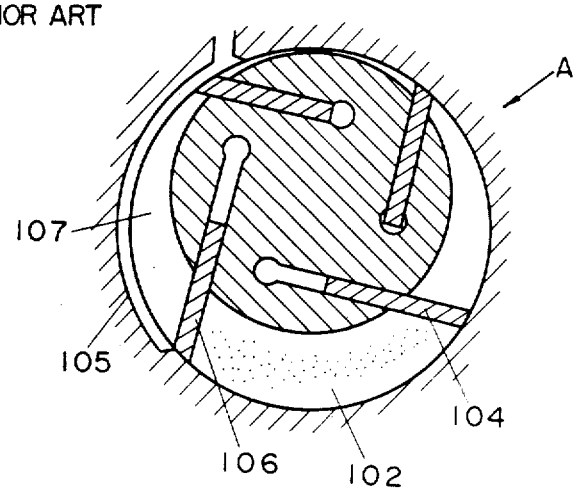
FIG. 5D PRIOR ART

Measured results of refrigerative capacity relative to the speed of rotation in this compressor having the above parameters, are shown in graphs in FIG. 4(*a*) and FIG. 4(*b*) as curve C, compared with curves A and B for prior art compressors (see FIGS. 5 and 9) with similar dimensions.

However, the above measured results were obtained under the conditions of Table 2 using a secondary refrigerant type calorimeter.

TABLE 2

| Parameter | Mark | Embodiment |
|---|---|---|
| Supply side pressure of refrigerant | $P_s$ | 3.13 kg/$cm^2$ abs. |
| Supply side temperature of ref. | $T_A$ | 283° K. |
| Discharging side pressure of ref. | $P_d$ | 15.51 kg/$cm^2$ abs. |
| Speed of rotation | N | 600–5000 rpm |

As can be seen, the compressor according to the present invention, had characteristics as follows:

(i) At low speed rotation, there is only a small drop in refrigerative capacity due to suction loss.

A reciprocating type compressor having a self-limiting refrigerative capacity has the characteristic that suction loss at low speed rotation is small, and in this rotary type compressor this characteristic was comparable with the reciprocating type compressor as can be seen from the graph of volume efficiency in FIG. 4(*b*).

(ii) At high speed rotation, the self-limiting effect of refrigerative capacity greater than that of a conventional reciprocating type compressor was achieved.

(iii) The self-limiting effect can be achieved when the speed or rotation has risen to more than 1800–2000 rpm, and thus a refrigerative cycle with ideal energy saving and good feeling operation can be achieved when the compressor of the invention is used as the compressor for a vehicle air conditioner. (Refer to refrigerative capacity curve in FIG. 4(*a*).

The results (i)–(iii) are ideal for vehicle air conditioner refrigerative cycles, and the remarkable characteristic of the present invention lies in the fact that these results can be attained without adding any new component to the conventional rotary type compressor.

Thus a compressor with self control of refrigeration capacity obtained without losing any of the normal characteristics of the rotary type compressor, i.e. that it is compact, lightweight and has a simple construction. In a polytropical variation of the suction stroke of the compressor, as the suction pressure becomes lower and the specific weight is smaller, the total weight of refrigerant in the vane chamber is smaller and the work of compression is smaller. Accordingly, in this compressor in which a decrease in the total weight of refrigerant is brought about automatically at a time just before the compression stroke at a high speed of rotation, a drop in driving torque inevitably occurs.

For the purpose of prevention of over-cooling, a method of controlling cooling capacity or compressibility by connecting a control valve to the high pressure side and low pressure side, and returning refrigerant from the high pressure side to the low pressure side valve by opening said control valve at a certain time has heretofore been used in refrigerative cycle of e.g. a room air conditioner. However, in this method, there is the problem that compression loss is generated due to inevitable re-expansion on the low pressure side, and a los of efficiency occurs.

In the compressor according to the present invention, self limiting action is achieved without performing useless work which causes such a compression loss, and a refrigerative cycle which is energy-saving and which has a high efficiency is achieved. Further, the compressor of the present invention, as described in the following, has a characteristic that a trnasitional phenomena in the vane chamber pressure is utilized effectively by a suitable combination of the parameters of the compressor, without the addition of any operating part such as a control valve. Therefore, it has high reliability.

Also, since the compression capacity varies continuously, there is no unnatural cooling characteristic due to a discontinuity as the result of a changeover when a valve is used, and control having a good operating feeling can be realized.

The above results have been gained, and the characteristic of the present invention lies in the fact that the self limiting characteristic is achieved effectively even in a compressor having many vanes, e.g. in a four-vane type compressor according to this embodiment.

In order to obtain a rotary compressor with the desired self-limiting characteristic, the present inventor studied the transitional following characteristic of the vane chamber refrigerant during the suction stroke of a conventional compressor, and performed a detailed theoretical investigation of characteristics which vary depending upon the speed of rotation.

We investigated the dependency of pressure drop character upon speed of rotation for two compressor having different suction courses and different numbers of vanes, and found two factors which greatly affect suction characteristics and also hinder achievement of control of compression capacity in conventional compressors. One factor is mutual intervention between two vane chambers at a time just before finishing of the suction stroke, and another fact is the variation in effective suction area during the suction stroke.

In the following, these will be explained in detail.

II. Analytic Results of Suction Characteristics in A Conventional Compressor.

Figure 9:
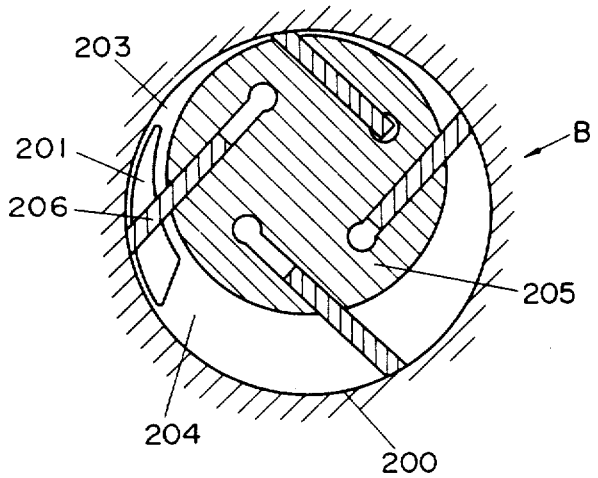
FIG. 9 PRIOR ART
FIG. 9 is a front sectional view of compressor B.

In order to grasp how the pressure flow-rate characteristic of the vane chamber differs during a suction stroke because of a difference in the construction and struction course of a compressor, three kinds of compressors, i.e. a compressor C according to the present invention as shown in FIG. 2 and conventional compressors A and B shown in FIG. 5 and FIG. 9 have been selected as object of the analysis.

II-I Analysis of compressor A

In the parts of FIG. 5, 100 designates a cylinder 101 a suction port 120 a vane chamber 103 a vane chamber 104 a vane between chambers 102 and 103, 105 a suction groove in the inner surface of cylinder 100, 106 a vane behind suction chamber 102, and 107 is a vane chamber behind vane 106. FIG. 5(*a*) shows the state at a time just after vane 104 has passed the top part 108 of cylinder 100, and the suction stroke has started.

FIG. 5(*b*) shows the state when vane 104 is passing over suction groove 105, and at this time, refrigerant is supplied to vane chamber 102 from suction port 101, and at the same time, it also flows into vane chamber 103 through suction grove 105.

FIG. 5(*c*) shows the state when vane 106 which follows vane 104 is travelling along suction groove 105, and at this time, refrigerant is supplied to vane chamber 102 only from suction groove 105.

FIG. 5(*d*) shows the state at a time just after vane 106 has passed the end of suction groove 105, and usually at this time $\theta \approx 225°$, and the volume of vane chamber 102 becomes a maximum.

In the following the analysis performed to understand the suction characteristic of the compressor comprising this construction will be described.

Although the basic formula describing vane chamber pressure differs for the states of each of FIGS. 5(*a*)–(*d*), for example, the basic formula for the state of FIG. 5(*c*) is as follows:

In FIG. 5(*c*), vane chamber 107 is designated the upstream side vane chamber, and vane chamber 102 is the downstream side vane chamber, and for vane chamber 107, the equilibrium formula for energy is as follows:

$$du + APdV - idG + dq = 0 \tag{1}$$

The first term of formula (1) is internal energy, the second term is energy required to rotate the compressor, the third term is the total heat energy of refrigerant flowing into and discharging from the vane chamber, and the fourth term is heat energy flowing into the vane chamber through the outer wall, and is a minute increment during a minute time.

Internal energy is $du = Cvd(G_0T_1)$, entropy is $i = CpT$, but flowing discharging entropy differs respectively since the temperature differs.

Namely:

$$idG = i_1dG_1 - i_2dG_2 \tag{2}$$

In above formula (2), the first term of the right side is the total heat energy of the refrigerant flowing into the upstream side vane chamber from the source of refrigerant, the second term of the right side is the total heat energy of refrigerant discharging from the upstream side vane chamber to the downstream side vane chamber. From the relation of $i_1 = C_pT_A$, $i_2 = C_pT_1$ and from the basic formula of thermodynamics $cp/Cv = K$, $C_p - C_v = AR$. Assuming that the suction stroke of the compressor provides an adiabatic change, i.e. $dq = 0$ and that refrigerant conforms to the law of ideal gas, the following energy equatation denoting the pressure in the upstream side vane chamber can be written:

$$T_AG_1 - T_1G_2 = \frac{1}{R}\frac{dV_1}{dt}P_1 + \frac{V_1}{\kappa R}\frac{dP_1}{dt} \tag{3}$$

For the downstream side vane chamber, the equilibrium formula of energy can be used similarly to obtain the equation:

$$T_1G_2 = \frac{1}{R}\frac{dV_2}{dt}P_2 + \frac{V_2}{\kappa R}\frac{dP_2}{dt} \tag{4}$$

Here, to the flow rate in weight $G_1$ and $G_2$ of refrigerant passing through each suction port or grove 101 or 105, the formula for an adiabatic nozzle without frictional loss is applied:

$$G_1 = a_1\sqrt{2g\gamma_AP_s\frac{\kappa}{\kappa-1}\left[\left(\frac{P_1}{P_s}\right)^{\frac{2}{\kappa}} - \left(\frac{P_1}{P_s}\right)^{\frac{\kappa+1}{\kappa}}\right]} \tag{5-1}$$

$$G_2 = a_2\sqrt{2g\gamma_1P_1\frac{\kappa}{\kappa-1}\left[\left(\frac{P_2}{P_1}\right)^{\frac{2}{\kappa}} - \left(\frac{P_2}{P_1}\right)^{\frac{\kappa+1}{\kappa}}\right]} \tag{6}$$

But, a critical pressure condition exists in formula (5-1) and (6) and when the following relation exists in e.g. formula (5-1):

$$P_1/P_s > \left(\frac{2}{\kappa+1}\right)^{\frac{2}{\kappa-1}} \tag{5-2}$$

$$G_1 = a_1\sqrt{2g\frac{\kappa}{\kappa+1}P_s\gamma A\left(\frac{2}{\kappa+1}\right)^{\frac{2}{\kappa-1}}}$$

Accordingly, by solving formulas (3)—(6) as a problem of initial period value in simultaneous different equations of two stage non-linear form, vane chamber pressures $P_1$ and $P_2$ are obtained.

In the above formulas, $C_p$: constant-pressure specific heat, $C_v$: constant-volume specific heat, R: gas constant, K: specific heat ration, $T_A$: refrigerant temperature at the supply side, $G_o$: total weight of vane chamber refrigerant, $P_s$: supply pressure, $P_1$: vane chamber pressure on the upstream side, $T_1$: vane chamber temperature on the upstream side, $V_1$: vane chamber volume on the upstream side, $P_2$: vane chamber pressure on the downstream side, $T_2$: vane chamber temperature on the downstream side, $V_2$: vane chamber volume on the downstream side, $G_1$: flow rate in weight of refrigerant flowing into upstream side vane chamber through suction port 101, $G_2$: flow-rate in weight of refrigerant flowing into downstream side vane chamber from upstream side through cylinder groove, $a_1$: effective area of suction port 101, $a_2$: effective area of cylinder groove, $\gamma A$: specific weight of refrigerant at the supply side, $\gamma 1$: specific weight of refrigerant in the upstream side vane chamber.

In order to evaluate the compressibility characteristic, the pressure dropping rate ($n_p$) is defined as follows:

$$\eta_p = \left(1 - \frac{P_{2s}}{P_s}\right) \times 100 \tag{7}$$

wherein:

$P_2 = P_{2s}$: vane chamber pressure at the time of finish of the suction stroke $P_s$: supply pressure.

Figure 6:
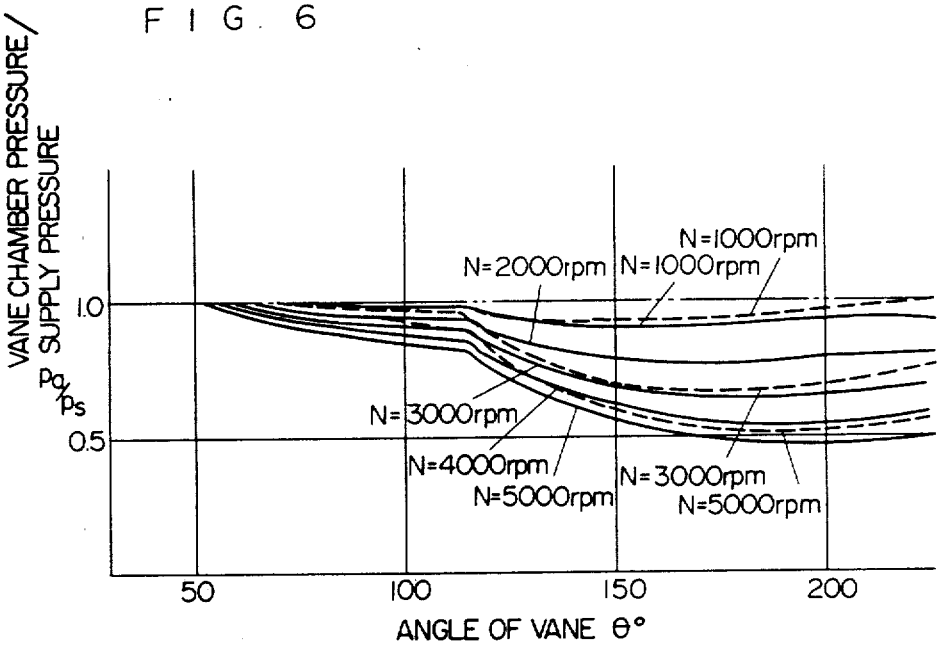
FIG. 6 is a graph showing the pressure characteristics of the vane chamber during the suction stroke of compressors A and compressor C.

FIG. 6 shows curves for the transitional characteristic of vane chamber pressure obtained using formulas (3)–(6), and the conditions of Tables 2 and 4, and making the speed of revolution a parameter with the initial condition of $t-0$, $P_1 = P_s$, $T_1 = T_A$. Since $R_{12}$ is usually used as refrigerant for a vehicle air conditioner refrigerative cycle, analysis was performed with the values of $k=1.13$, $\gamma A=16.8\times10^{-6}$ kg/cm$^2$, $T_A=283°K$. The solid line is for compressor A, and the chain like is for an embodiment according to the present invention. The size and portion of the suction port and suction groove are as indicated at $a_1$ and $a_2$ in Table 4.

TABLE 4

| Parameter | Mark | Embodiment |
|---|---|---|
| Numbers of vane | $\eta$ | 4 |
| Position of suction port | $\theta_1$ | 25° |
| Effective area of suction port | $a_1$ | 0.8 cm |
| Effective area of suction groove | $a_2$ | 0.25 cm |
| Rotational angle end of vane at suction stroke finish time | $\theta_s$ | 225° |
| Width of cylinder | B | 2.75 cm |
| Inner dia. of cylinder | $D_c$ | 7.8 cm |
| Outer dia. of rotor | $D_r$ | 6.4 cm |

Even at angle $\theta=225°$ when the suction stroke finishes during low speed compressor rotation of 107 =1000 rpm, the vane chamber pressure does not reach the supply pressure ($P_s$), and thus pressure loss ($\Delta P$) is produced.

The reason for this is that when the suction stroke of the upstream vane chamber finishes, the downstream vane chamber is at a position of $\theta=225°-90°=135°$, and its volume is increasing rapidly so that pressure drop has begun already. Since the pressure at the downstream side cannot be higher than the pressure at the upstream side, said pressure loss $\Delta P$ is also produced at low speed rotation, and thus a drop in volume efficiency is brought about.

Figure 7:
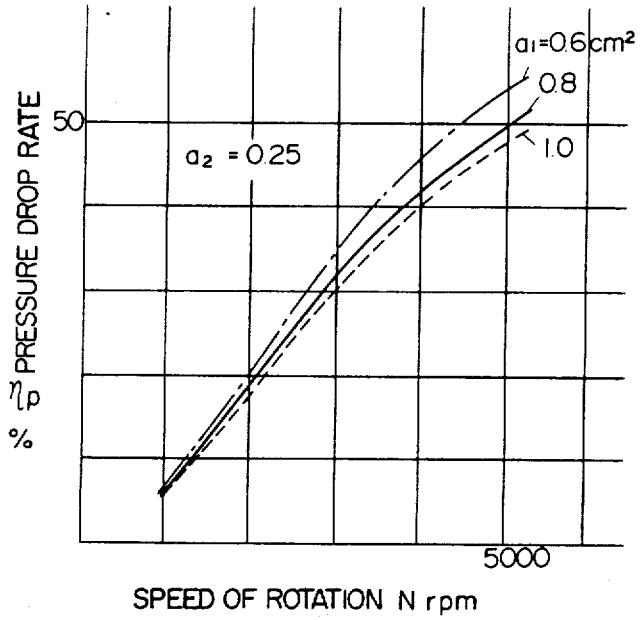
FIG. 7 is a graph showing the pressure drop rate when the effective area ($a_1$) in the front half of compressor A is varied.

FIG. 7 shows the characteristice of the pressure drop rate as the effective area $a_1$ of suction port 101 is varied while the effective area $a_2$ of the suction groove 105 is maintained constant. At high speed, the tendency is that as $a_1$ becomes larger, the decrease in the pressure dropping rate ($\eta_p$) becomes smaller, but it has little effect in decreasing the pressure loss at low speed rotation.

Figure 8:
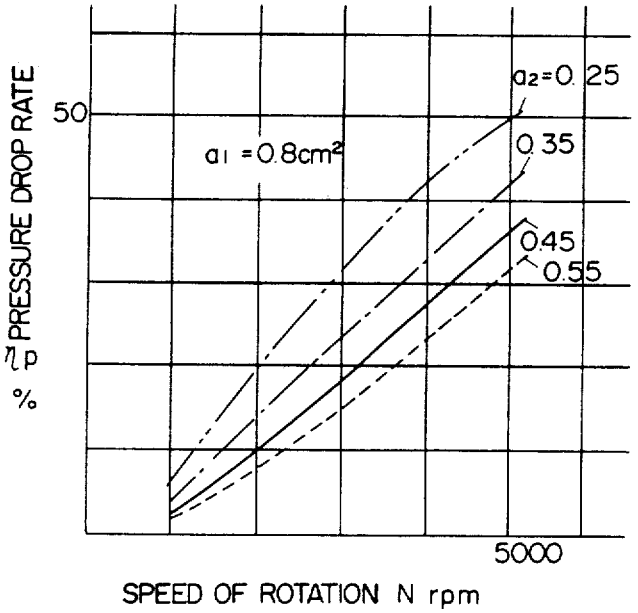
FIG. 8 is a graph showing the pressure drop rate when the effective area ($a_2$) at the rear half of the same compressor is varied.

FIG. 8 shows the characteristic of the pressure drop rate when the effective area $a_2$ of the suction groove 105 is varied while the effective area $a_1$ of the suction port 101 is maintained constant. It will be seen that when $a_2$ is increased, suction loss at low speed decreases, but the pressure drop rate, which affects the compressibility control, is decreased. From the above results, in the construction of compressor A, when good compressibility control effect at high speed is desired, suction efficiency, and volume efficiency, at speeds of $\omega=1000-2000$ rpm is sacrificed.

FIGS. 4(*a*) and 4(*b*) show measured results for compressor A using a calorie meter.

The reason why refrigerative capacity (Q) and volume efficiency, $\eta_v$ are low as compared with compressors B and C is that the quantity discharged from the compressor is small, but from the gradient of the curve, it can be seen that this compressor is not suitable for achieving the desired compressibility control. In spite of the fact that volume efficiency is low at low speed rotation $\omega=1000-2000$ rpm, hardly any self limiting action of refrigerative capacity at high speed can be obtained.

II—II Analysis of compressor B

FIG. 9 shows the construction of compressor B having cylinder 200 and rotor 205 in which the suction port 201 is formed in a side plate. Vane chamber 203 is behind vane 206 and vane chamber 204 is ahead of vane 206.

In said compressor, the cross-sectional area of the supply pipe connected with suction port 201 is assumed to be sufficiently large. Assuming that the ability to supply refrigerant from the supply side is constant and not affected by vane chamber pressure, the basic formulas denoting vane chamber pressure, the vane chamber energy equation and the formula for nozzle flow rate are applicable.

Accordingly, putting into formulas (4) and (6) the valves $T_A=T_1$, $V_a=V_2$, $\gamma_A=\gamma_1$, $P_a=P_2$, $=P_s$, $=P_1$, $a=a_2$, the vane chamber pressure can be obtained by solving the following one stage differential equation for the initial period condion of $t=0$, $V_a=0$, $P_a=P_s$.

$$G=\frac{1}{RT_A}\frac{dV_a}{dt}P_a+\frac{V_a}{\kappa RT_A}\frac{dP_a}{dt} \tag{8}$$

$$G=a\sqrt{2g\gamma_A P_s\frac{\kappa}{\kappa-1}\left[\left(\frac{P_a}{P_s}\right)^{\frac{2}{\kappa}}-\left(\frac{P_a}{P_s}\right)^{\frac{\kappa+1}{\kappa}}\right]} \tag{9}$$

Figure 10:
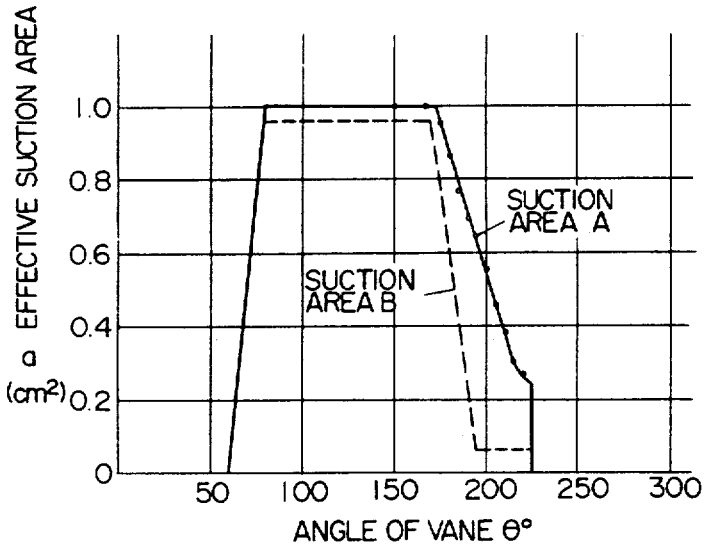
FIG. 10 is a graph showing effective suction area of the compressor of FIG. 9.

FIG. 10 shows the effective area during the suction stroke, and the suction area curve a is for the case where the area of suction port 201 formed in the side plate is sufficiently large, and suction area curve b is for the case where the suction area is throttled at a time just before the finish of the suction stroke ($194°<\theta<225°$).

Figure 11:
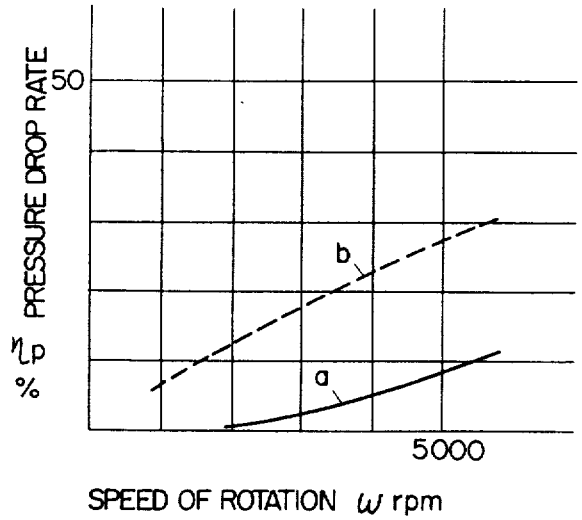
FIG. 11 is a graph showing pressure drop rate of the compressor of FIG. 9;.

In the case of suction area curve a, as can be seen from FIG. 11, suction loss at low speed can be made small, but at high speed time, little pressure drop is produced. Accordingly, in this construction, hardly any compressibility control can be achieved.

In the case of suction area curve b, even at a low speed of $N=1000$ rpm, a suction loss $\eta_p=7$–$8\%$ exists, and it is assumed that a drastic drop in volume efficiency occurs. Further, the gradient of pressure drop rate relative to the speed of rotation is small and the self limiting compressibility effect at high speed time is small.

The reason why compressibility control is not achieved effectively in this compressor is that since suction port 201 is provided in the space between rotor 205 and cylinder 202, the effective suction area has been tapered inwardly at a position just before the finish of the suction stroke, i.e. when vane 206 trasverses suction port 201. When the effective suction area has a tapered shape the compressibility control characteristic becomes inferior.

FIGS. 4(*a*) and 4(*b*) show results measured by calorie meter for compressor B and it can be seen that conditions required for compressibility control are hardly satisfied, similar to compressor A.

III Explanation on the Principal of this Invention

As decribed above, the investigation of conventional compressors having many vanes has been performed, and as a result, it has been found that the ideal compressibility control characteristics difficult to obtain in conventional constructions. The desired characteristic is obtained in the present invention by having separate ports 15 and 17 for two chambers, e.g. 18*a* and 18*b* in FIG. 3, separated by a vane, so that they are supplied with refrigerant from each suction port independently, i.e. without mutual interference. Accordingly, in the basic formulas denoting chamber pressure, energy for one nozzle or suction port, mode of one dimension as shown at electric circuit model in Table 3 is formed.

Figure 12:
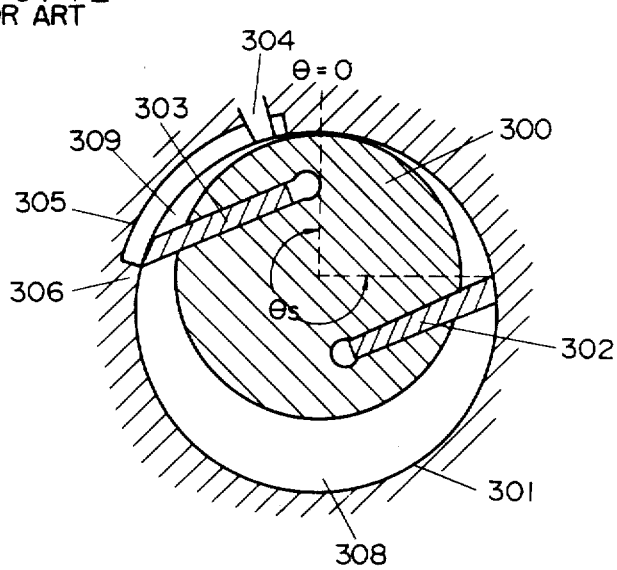
FIG. 12 PRIOR ART
FIG. 12 is a front sectional view of a two vane type rotary compressor.

FIG. 12 shows a conventional two-vane type compressor as a reference. In this figure, 300 designates the rotor, 301 the cylinder, 320 one vane, 303 a second vane, 304 a suction port, 305 a suction groove, 306 the end of the suction groove, 308 the downstream side vane chamber, and 309 the upstream side vane chamber. In the figure, the state is shown where vane 303 has reached the end 306 of suction groove, and supply of refrigerant into the vane chamber 308 is ended and the suction stroke has finished. In a two-vane type compressor, at the time when the suction stroke has finished, volume $V_2$ of the upstream side vane chamber 309 is small compared with the volume $V_1$ of the downstream side vane chamber 308, and $V_2/V_1=8$–$9\%$. On the other hand, in the vane type compressor as shown in FIG. 5, $V_2/V_1=45$–$50\%$.

Thus, in a two vane type compressor, having the dimensions of compressor C from Table 3, by proper selection of parameters an ideal compressibility control characteristic can be obtained.

In the present invention, a superior compressibility control characteristic is obtained in a rotary compressor with more than two vanes by providing two suction ports 15 and 17 (FIG. 2) and supplying refrigerant into a downstream vane chamber from first one and then the other during the suction stroke without any influence from the upstream vane chamber.

In a four-vane type compressor, the volume $V_a(\theta)$ of a vane chamber is obtained from the following formula. Making $m=R_r/R_c$, $$V(-\theta)=\frac{bR_c^2}{2}\left\{(1-m^2)\theta+\frac{(1-m)^2}{2}\sin 2\theta-(1-m)\sin\theta\times\sqrt{1-(1-m)^2\sin^2\theta}-\sin^{-1}[(1-m)\sin\theta]\right\}+\Delta V(\theta) \tag{10}$$

where $0<\theta<\pi/2$, $V_a(0)=V(\theta)$ and
$\pi/2<\theta<\theta_s$, $V_a(\theta)=V(\theta)-V(\theta-\pi/2)$ $\Delta V(\theta)$ being a correction term for the eccentric position of the vane relative to center of rotor, but this value is usually on the order of 1–2%.

As can be seen from the above formula (10), the volume of vane chamber ($V_a$) is a function of the rotor diameter (Rr), cylinder shape etc., but formulas (8), (9) and (10) use an approximate function, and a method to grasp the correlation between each parameter and the compressibility control effect is proposed.

The maximum suction volume of refrigerant is $V_0$, and by putting $\psi=\Omega t=(\pi\omega/\theta_s)t$, the angle $\theta$ is transduced to $\psi$. In this case, $\psi$varies from 0 to $\pi$, and an approximate function, $f(\psi)$ is defined such that at $t=0$, $f(\psi)=f(0)$, $f'(0)=0$, and at the time when the suction stroke finishes i.e. at $t=\theta_s/\omega$, $f(\pi)=1$, $f'(\pi)-0$. In this case, volume ($V_a$) is denoted as follows:

$$V_a(\psi)=V_0 f(\psi) \tag{11}$$

In formula (11), $V_0$ and $f(\psi)$ are functions of Rf and Rc, but $f(\psi)$ varies very little relative to Rf and Rc. For example, $$f(\psi)=\tfrac{1}{2}(1-\cos\psi) \tag{12}$$

Here, putting as $\eta=P_a/P_s$, formula (8) becomes:

$$G=\frac{P_s\Omega V_0}{R_{TA}}\left(f(\psi)\cdot\eta+\frac{f(\psi)}{\kappa}\cdot\frac{d\eta}{d\psi}\right) \tag{13}$$

And formula (9) becomes:

$$G=a\sqrt{P_s\cdot\gamma_A\cdot 2g\cdot\frac{\kappa}{\kappa-1}\left[\eta^{\frac{2}{\kappa}}-\eta^{\frac{\kappa+1}{\kappa}}\right]} \tag{14}$$

From formula (13) and (14):

$$K_1\cdot g(\eta)=f(\psi)\cdot\eta\frac{f(\psi)}{\kappa}\frac{d\eta}{d\psi} \tag{15}$$

$$g(\eta)=\sqrt{\frac{\kappa}{\kappa-1}\left(\eta^{\frac{2}{\kappa}}-\eta^{\frac{k+1}{\kappa}}\right)} \tag{16}$$

$K_1$ becomes a non-dimensional quantity, and:

$$K_1=\frac{2a\theta_s}{V_0\pi\omega}2gRT_A \tag{17}$$

In a sliding vane type compressor, making Vth the theoretical discharging quantity, n the number of vanes, usually $Vth=n\times V_0$, and formula (17) becomes as follows:

$$K_1=\frac{2a\theta_s n}{Vth\pi\omega}2gRT_A \tag{18}$$

in above formula (18), the specific heat ratio (k) is a constant dependent only on the kind of refrigerant. The effective suction area (a) is a function of the non-dimensional vane traveling angle ($\psi$), and accordingly parameter $K_1$ also becomes a function of $\psi$. Therefore, the solution of formula (15) $\eta=\eta(\psi)$ is decided primarily when value of $K_1(\psi)$ is decided.

Since gas constant (R) and supply side refrigerant temperature ($T_A$) are set under identical conditions, the following function $K_2(\psi)$ can be re-defined.

$$K_2(\psi)=a\theta_s/V_0 \tag{19}$$

Figure 13:
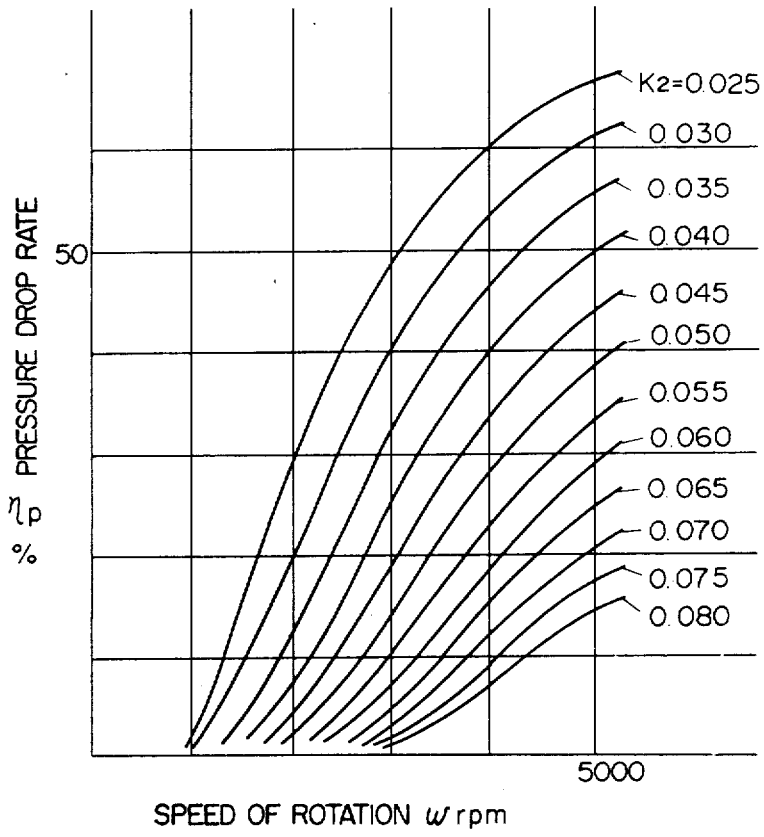
FIG. 13 is a graph of the pressure drop rate in terms of parameter $K_2$.
Figure 14:
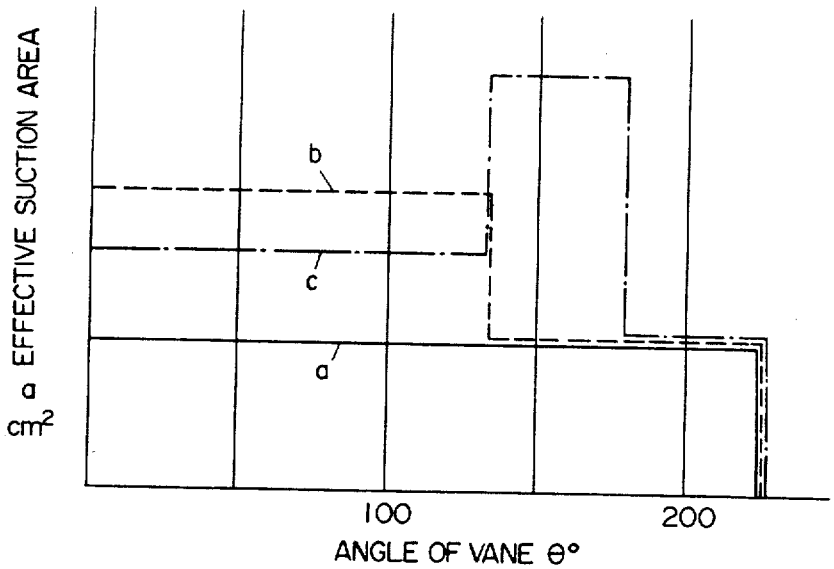
FIG. 14 is a graph showing the effective suction area, for different relations of the areas of the suction ports of the compressor of the invention.

For effective area ($a_1$) of suction port 15 and effective area ($a_2$) of suction port 17, a graph of effection suction areas when $a_1=a_2$ is shown in curve a of FIG. 14. A graph of pressure drop rate ($\eta p$) relative to the speed of rotation ($\omega$) is shown in FIG. 13. When the effective suction area is constant during the suction stroke $K_2$ becomes constant, and it will be seen that the compressibility control characteristic can be selected at will by setting of $K_2$. The result of a traveling test of a car having therein a compressor the parameter $K_2$ of which is varied were as shown in Table 5. Further, the method of measuring of effective suction area to obtain $K_2$ will be described later in connection with FIG. 29.

As can be seen from the results in Table 5, when $K_2$ is set within the range of $0.025<K_2<0.080$, a good compressibility control characteristic is obtained.

TABLE 5

| Number of rotation | Compressibility control effective (pressure drop rate) | $K_2$ | Test result |
|---|---|---|---|
| 1800 rpm | 22.5% | 0.025 | Efficiency at low speed drops somewhat. But, when compressor having capacity more than th = 95 c.c./rev. is used, it was O.K. in relation to refrigerative ability |
| | 9.0 | 0.035 | There is some loss in efficiency, but it was sufficient practically. |
| | 4.5 | 0.040 | Dropping in efficiency was little. Refrigerative cycle of ideal energy-saving and high efficiency can be built-in. |
| 4600 rpm | 21.5 | 0.065 | In compressibility control at high speed, and energy-saving effect, best condition was achieved |
| | 18.0 | 0.070 | Nearly equivalent effect to conventional reciprocating type was achieved. Practically sufficient compressibility control. |
| | 12.0 | 0.080 | Compressibility control effect is somewhat insufficient, but in case of car having capacity more than 2000 c.c. it was O.K. on cycle design. |

In case of $a_1 > a_2$, the effective suction area becomes a stepped curve as shown in curve b in FIG. 14. In this case, there is an advantage that the suction loss is decreased, and low torque can be used at low speed.

However, the gradient of the pressure drop rate relative to the speed of rotation decreases somewhat, and the compressibility control effect decreases. Therefore it is necessary to make the effective suction area at the rear half somewhat smaller.

Here, making $K_2 = a_2\theta s/V_0$, by the setting value of $K_2$ within a range of $0.025 < K_2 < 0.065$, a sufficient practical compressibility control characteristic was obtained.

IV Other Embodiments of the Present Invention.

Figure 15:
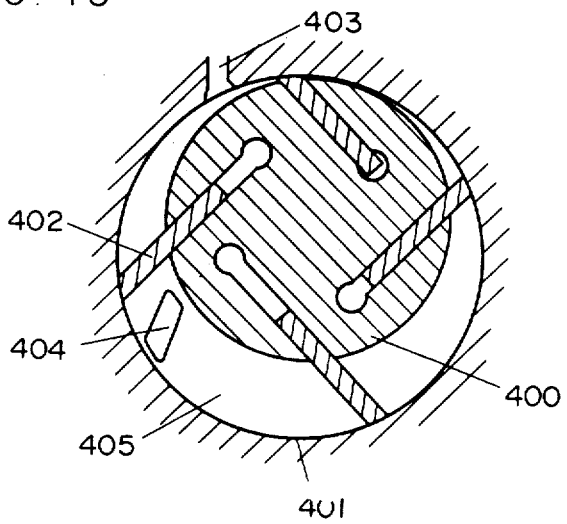
FIG. 15 is a front sectional view of a compressor in which a suction port is formed in the side plate according to another embodiment of the present invention.

FIG. 15 shows the concentration of a compressor in which one of the two suction ports is formed in a side plate. In this figure, 400 designates a rotor, 401 a cylinder, 402 the vanes, 403 a suction port formed in the cylinder 401 and 404 is the suction port formed in the side plate 405.

In this construction, each suction port 403 and 404 is formed similarly so that changeover of the two suction ports is performed during the suction stroke, and also so that supply of refrigerant into the vane chamber is interrupted at the time of finish of the suction stroke due to the port being covered by vane 402.

Figure 16A:
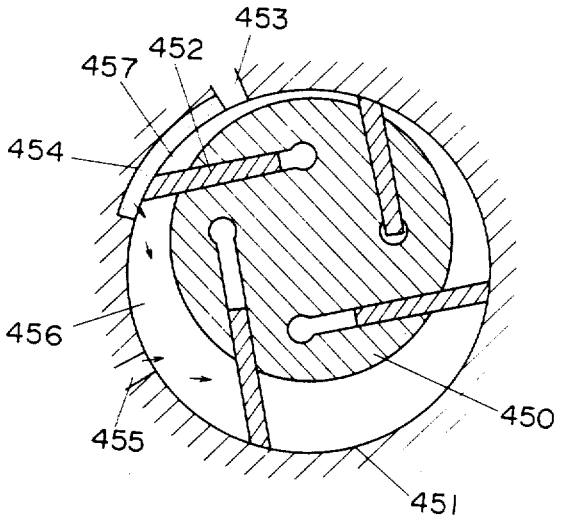
FIGS. 16(*a*) and (*b*) are front sectional views showing the flow state of refrigerant during the suction stroke in another embodiment of the present invention.
Figure 16B:
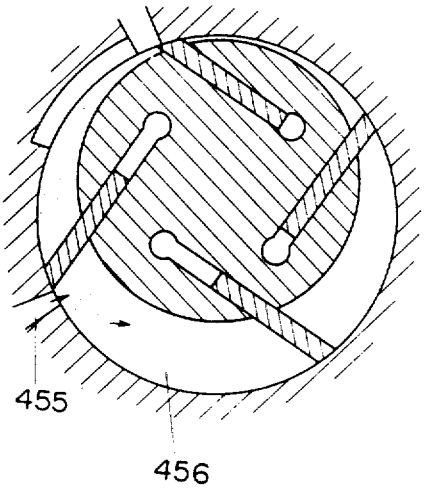

FIGS. 16*a*–16*b* show an embodiment in which a suction groove is formed extending along the cylinder from suction port 453 and there is a point in the cycle where refrigerant is supplied from both suction ports.

In the figure, 450 designates a rotor, 415 a cylinder, 452 vanes, 453 a suction port, 454 a suction groove, 455 a suction port, 456 a vane chamber, behind vane 452, and 457 a vane chamber ahead of vane 452.

As seen in FIG. 16*a*, refrigerant is supplied into vane chamber 456 from both suction port 453 through groove 454 and from suction port 455. FIG. 16*b* shows the state at a time just before the finish of the suction stroke for vane chamber 456, and refrigerant is suppled only into vane chamber 456 from suction port 455. The effective suction area during suction stroke in this case is shown by curve c in FIG. 14.

Figure 17:
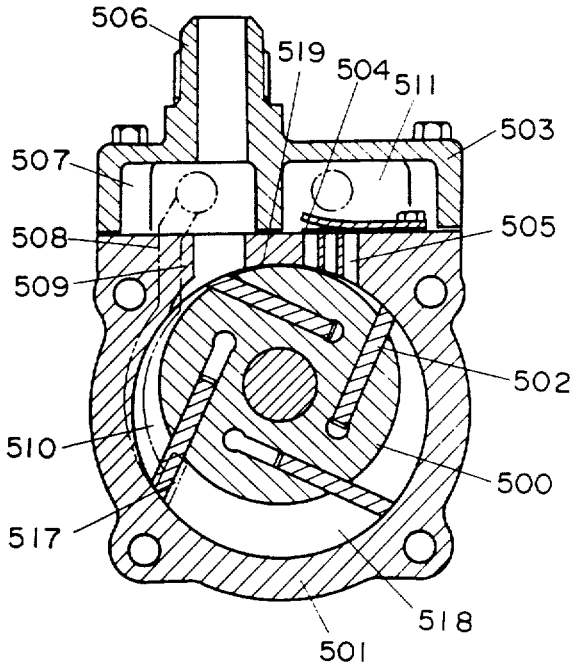
FIG. 17 is a front sectional view of four vane type compressor according to a further embodiment of the present invention.
Figure 18:
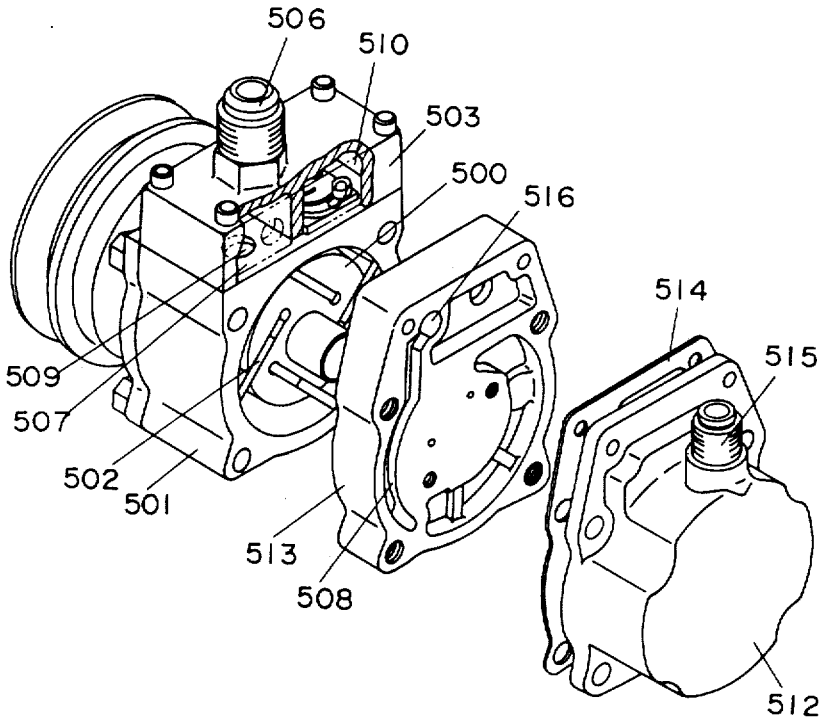
FIG. 18 is an exploded perspective view of the compressor of FIG. 17.

FIGS. 18 and 18 show a practical construction of the present invention, and in the figures, 500 designates rotor, 501 a cylinder, 502 vanes, 503 a head cover, 504 a discharging valve, 504 a discharging port, 506 a connector for suction piping, 507 a suction chamber formed between said cylinder 501 and the inside of head cover 503, 508, shown by one dot chain line, a suction passage formed in the rear casing part (not shown in FIG. 17), 509 a suction port between said suction chamber 507 and vane chamber 510 upstream of a vane, 511 a vent chamber, 517 a suction port, and 518 a vane chamber downstream of said vane.

In FIG. 18, 512 and 513 designate a rear case and rear plate which corresponds to side plates, 514 a gasket, 515 a connector for discharging piping, and 516 designates a communicating passage to communicate suction chamber 507 with suction passage 508.

In the compressor of this embodiment, a suction passage 508 is formed in rear plate 513 along gasket 514, and the supply of refrigerant to vane chamber 510 is through suction piping joint 506, suction chamber 507, suction port 509 to vane chamber 510.

On the other hand, supply of refrigerant to vane chamber 518 is through suction piping joint 506 suction chamber 507, communicating passage 516, suction passage 508, suction port 517 and into vane chamber 518.

In the compressor of this embodiment, the suction side and discharge side separated to the left and right of a boundary point formed by the top part 519 of cylinder 501. Thus, by providing the head cover 503 above top part 519, vent chamber 511 accommodating discharging valve 504 and suction chamber 507 communicated with suction piping connector 506 can be formed by head cover 503 as a body construction.

Accordingly, the supply of refrigerant into the two suction ports branches into two paths at the rear of suction chamber 507, but only a single suction piping joint is needed. Therefore, in this compressor, in spite of the fact that it has the desired compressibility control fuction, is simple and compact similar to a conventional rotary type compressor.

Figure 19A:
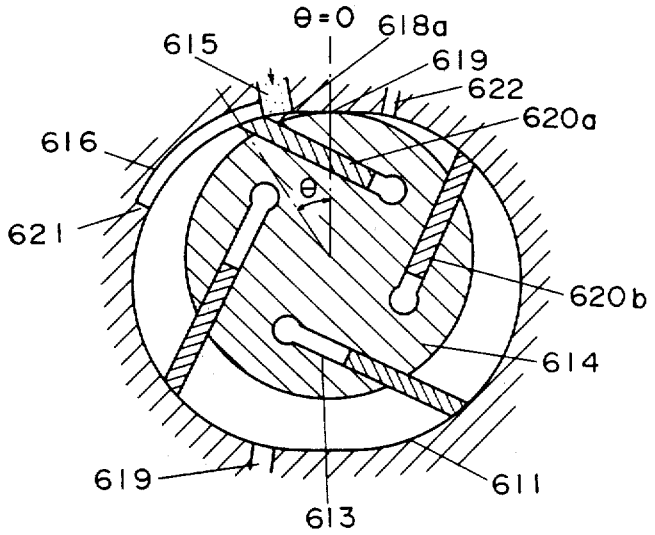
FIGS. 19(*a*)–(*e*) are explanatory drawings showing the suction stroke of compressor according to another embodiment of the present invention having a non-circular shape.
Figure 19B:
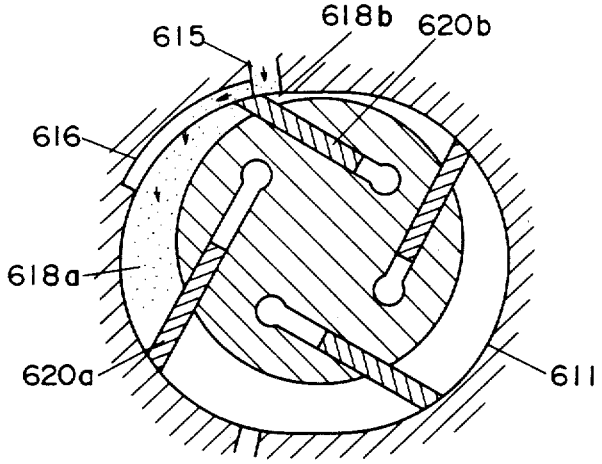
Figure 19C:
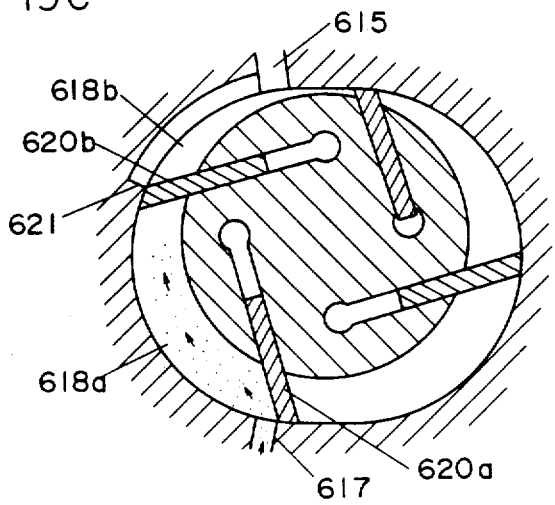

FIGS. 19*a*–19*c* show an embodiment of the compressor of the invention which makes the present invention more effective. This embodiment seeks to provide a compressor with a compressibility control function in which loss in refrigerative ability at low speed is small, and self restricting refrigerative ability at high speed can be gained more effectively. This is accomplished by using a cylinder shape in which the rate of varying of the volume curve for the vane chamber in the neighborhood of the finish of the suction stroke becomes small compared with the conventional volume varying rate curve.

Figure 20:
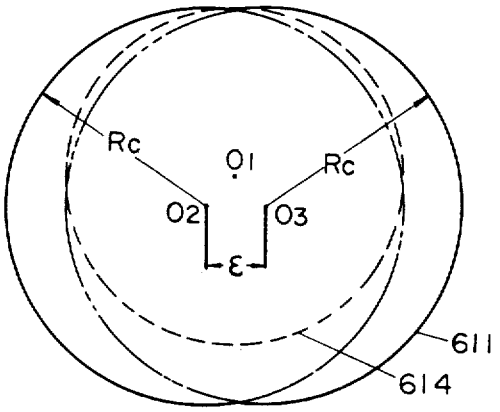
FIG. 20 is an explanatory drawing showing cylinder shape of the embodiment of FIG. 19.

In the figure, 611 designates a cylinder having the shape of two parts of a circle with the centers spaced a distance $\epsilon$ as shown in FIG. 20, 613 designates sliding grooves for the vanes, 614 a rotor, 615 a suction port, 616 a suction groove, 617 a further suction port, and 622 a discharging port.

The suction stroke of this compressor will be described using FIGS. 19*a*–*e*. In these figures, 618*a* designates a vane chamber ahead of vane 620*b*, 618*b* a vane chamber behind vane 620b, 619a the top part of cylinder 611, 620a a vane, 620b a vane, and 621 the end of suction groove 616. The angular position when the end of vane 620a which is passing the top part 619 of cylinder 611 around the rotational center of rotor 614 is $\theta=0$, and the angular position of the end of the vane at any position relative to said original point is $\theta$. Noting vane chamber 618a, FIG. 19a show the state where vane 620a has passed top part 619 and is travelling along suction groove 616.

FIG. 19b shows the state where vane 620b following vane 620a is traveling along suction groove 616, and in this case, refrigerant is supplied into vane chamber 618a through suction groove 616. In this embodiment, by making suction groove 616 in the inner face of cylinder 611 sufficiently deep, the effective area ($a_2$) of suction port 616 relative to effective area ($a_1$) of suction port 615 can be made to be $a_2>>a_1$. Accordingly, the effective suction area of the passage communicating between vane chamber 618a and the refrigerant supply in FIGS. 19a and *b*, is almost entirely determined by the effective area ($a_1$) of suction port 615.

FIG. 19c shows the state at a time just after vane 620a has passed suction port 617, and at the same time, vane 620b has passed the end 621 of suction groove 621.

At this time, the supply of refrigerant from suction port 615 to vane chamber 618a is interrupted by vane 620b, and in place thereof, supply from suction port 617 is begun.

In this embodiment, the effective area $a_3$ of suction port 617 is made to be $a_3=a_1$.

Accordingly, in this compressor the effective suction area of the passage from the supply of refrigerant to the vane chamber is always constant during the suction stroke.

Figure 19D:
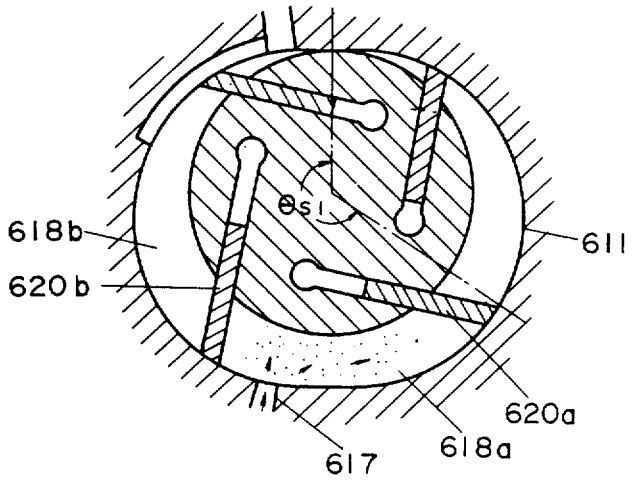

FIG. 19d shows the state where traveling angle ($\theta$) of vane 620a has reached half the traveling angle of the suction plus the compressing stroke. In the conventional four vane type compressor having a true circular shape cylinder it is $\theta=0_{s1}\approx225°$, and at this time, the vane chamber volume becomes a maximum.

However, in the embodiment of the present invention, the suction stroke is not finished yet, and refrigerant is supplied from suction port 617 to vane chamber 618a.

Figure 19E:
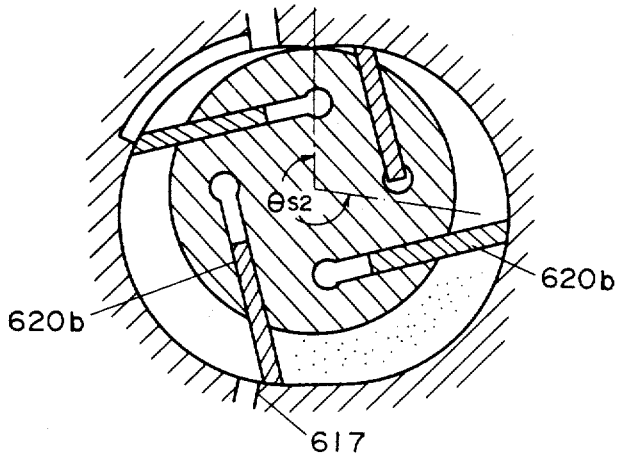

FIG. 19e shows the state at the time just after vane 620b has passed suction port 617, and since the supply of refrigerant from suction port 617 is interrupted by vane 620b, the suction stroke is finished at this time.

As shown in FIG. 20, $O_2$ is center of the left hand part of the cylinder, $O_3$ is the center of the right hand part, and center $O_1$ of rotor 14 is at a point equidistant from centers $O_2$ and $O_3$.

Figure 21:
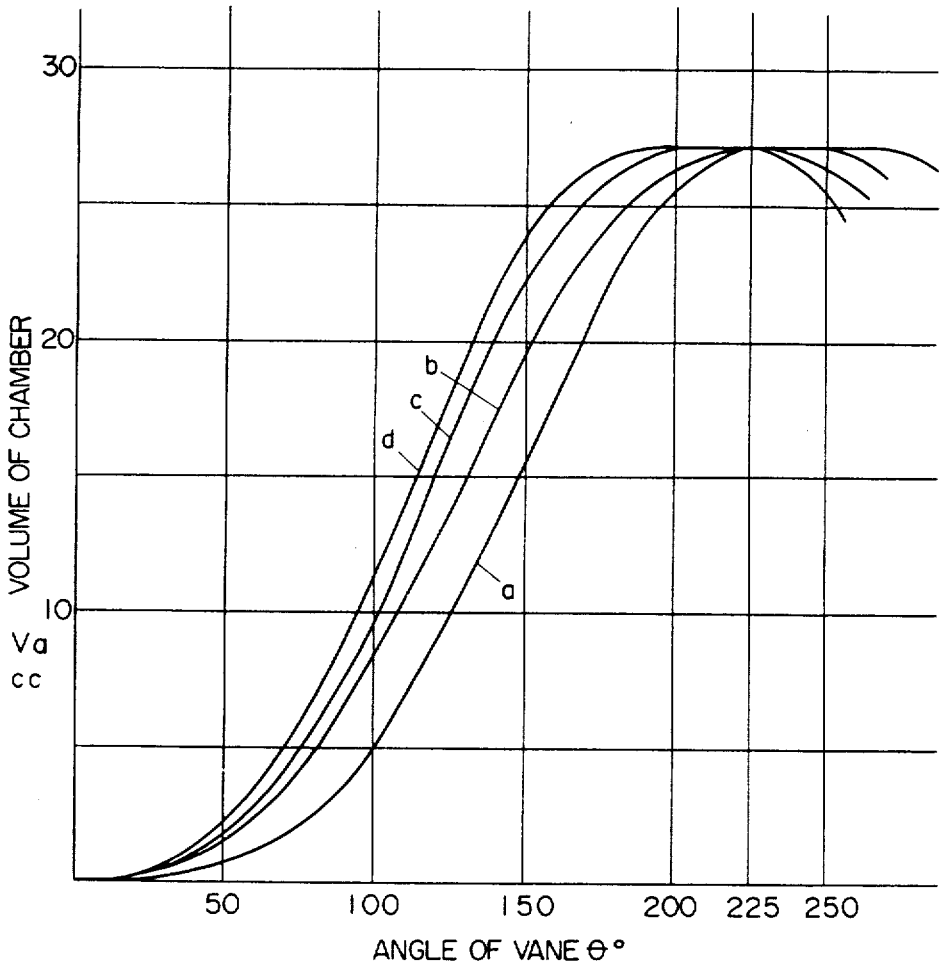
FIG. 21 is a graph of the volume curves of the compressor of FIG. 19.

Volume curve $V_a(\theta)$ for a vane chamber formed by said cylinder 611, rotor 614, vanes and side plates and a spacing $\epsilon$ of the centers, and relative to vane angle $\theta$ is shown as curves b-d in FIG. 21 with parameter of spacing $\epsilon$. Further, curve (a) is the volume curve of a conventional compressor in which the cylinder is one true circle. Curve (b) is for $\epsilon=5$ mm, curve (c) is for $\epsilon=8$ mm, and curve (d) is for $\epsilon=10$ mm.

When the spacing $\epsilon$ between centers becomes large, variation of the volume curve near $\theta=\theta_{s1}=225°$ becomes small, e.g. when $\epsilon=8$ mm, it may be seen that the volume curve becomes nearly flat in the range of $200°<\theta<250°$.

In the embodiment of FIG. 19, suction port 617 was arranged so that refrigerant was supplied into the vane chamber until vane angle $\theta$ reaches $\theta=\theta_{s2}=250°$. In a conventional four vane type compressor, the finishing angle of the suction stroke is $\theta=\theta_{s1}=225°$ where the volume $V_a$ of the vane chamber becomes a maximum, but by using the cylinder shape of FIG. 19, the finishing angle $\theta_{s2}$ of the suction stroke can be increased up to $\theta=\theta_{s2}=250°$.

When the conventional cylinder shape is used, if $\theta_{s1}$ is increased, suction loss is produced due to gradual decreasing of the volume. When said cylinder shape is used, since the flat part of the volume curve can be utilized, said suction loss is not produced.

A compressor according to FIG. 19 one embodiment of the present invention was constructed with the following parameters:

TABLE 6

| Parameter | Mark | Embodiment |
|---|---|---|
| Number of vanes | n | 4 |
| Effective area of suction port A | $a_1$ | 0.20 $cm^2$ |
| Effective area of suction groove 16 | $a_2$ | 0.6 $cm^2$ |
| Effective area of suction port B | $a_3$ | 0.20 $cm^2$ |
| Rotor diameter | Rr | 28 mmR |
| Cylinder diameter | Rc | 33 mmR |
| Distance between cylinder circles | $\epsilon$ | 8 mm |

In this compressor, the effect of the present invention is increased compared with an embodiment having a cylinder in the shape of a true circle. Namely, in this embodiment, in spite of the fact that there is almost no loss in refrigerative capacity at low speed rotation, when it reaches more than a certain speed of rotation, refrigerative capability is limited more drastically.

Figure 22:
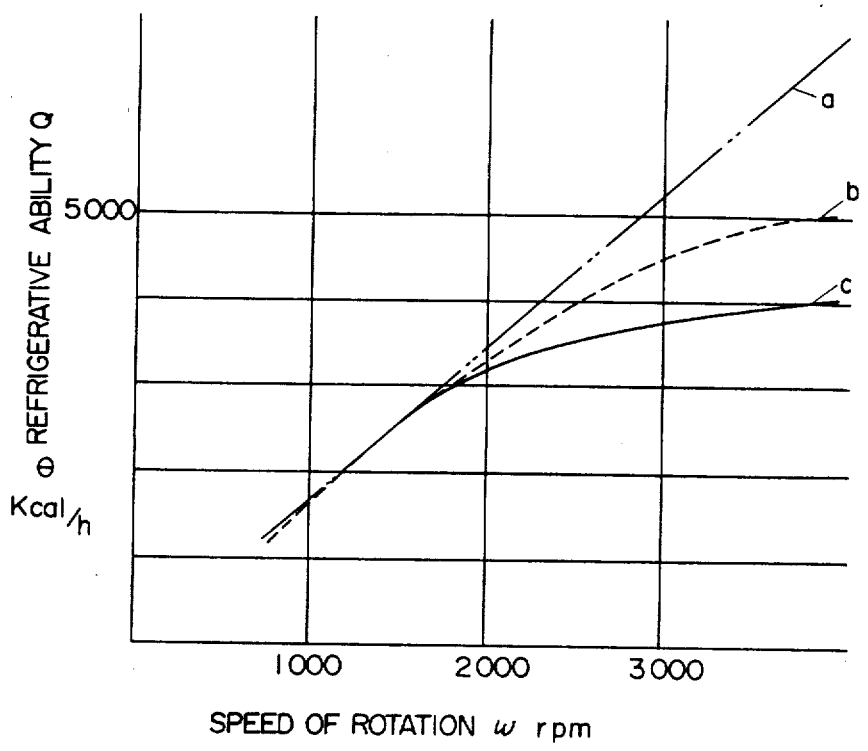
FIG. 22 is a graph of the refrigerative capacity relative to the speed of rotation for the compressor of FIG. 11.
Figure 23:
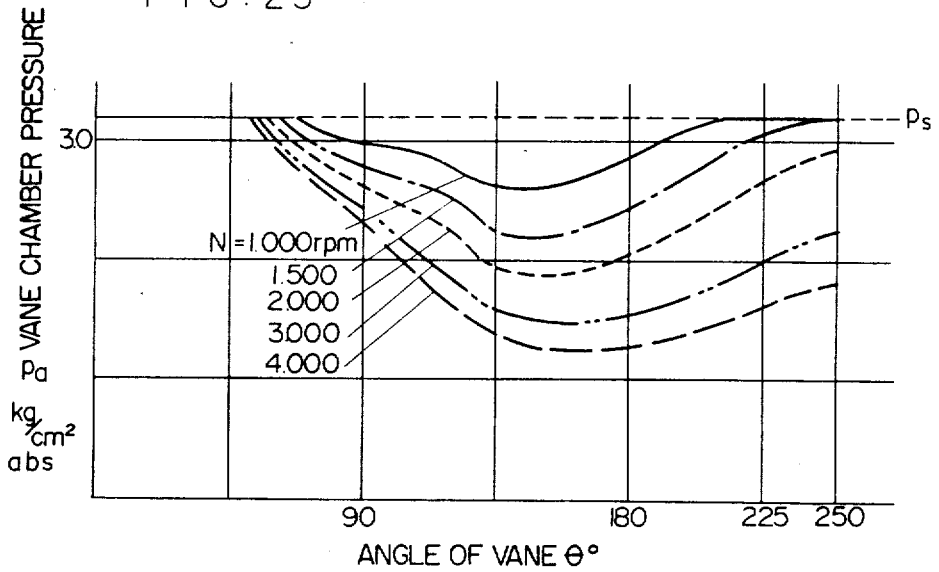
FIG. 23 is a graph showing the vane chamber pressure characteristic of the compressor of FIG. 19.

FIG. 22 shows the refrigerative capacity characteristic relative to the speed of rotation, and straight line (a) being the characteristic of a conventional rotary compressor without compressibility control, curve (b) shows the characteristic for the embodiments previously described in said Japanese Patent Application, and curve (c) being the characteristic of a compressor of the present embodiment (FIG. 19) of the present invention.

In the compressor of the present embodiment, the drop in the rate of the refrigerative capacity of about 28.5% at $\omega=3000$ rpm, and about 42% at $\omega=4000$ rpm. Thus it is seen that it has an ideal characteristic for a compressor for a vehicle air conditioner.

Figure 24:
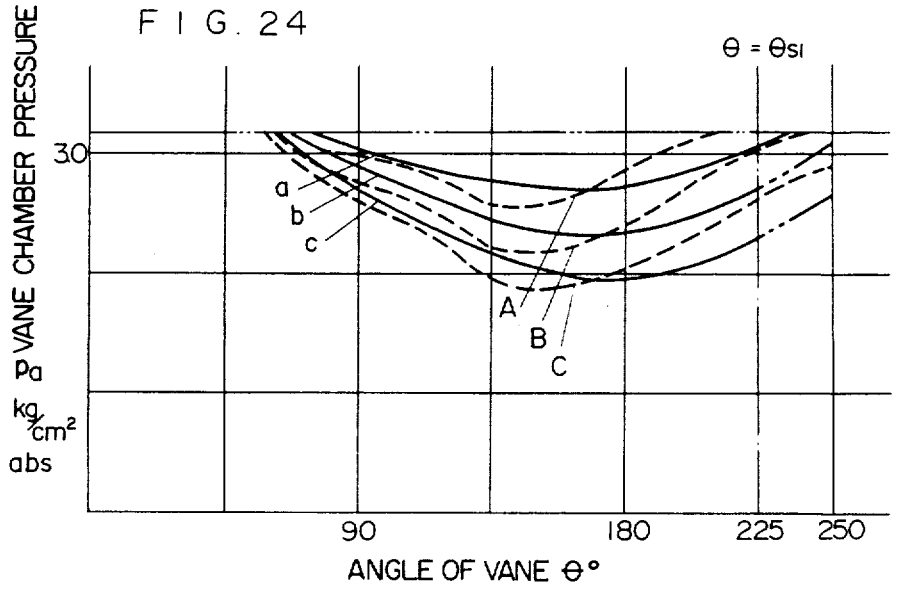
FIGS. 24 and 25 are graphs comparing the vane chamber pressure characteristics of a compressor of FIG. 19 to that of a conventional compressor.

FIG. 24 shows a comparison of the vane chamber pressure characteristic for a compressor with a true circular shaped cylinder and the FIG. 19 embodiment of this invention using identical effective suction areas $a_1=a_2=0.2$ $cm^2$.

The solid lines are for the compressor with a true circular shaped cylinder and the chain lines for the compressor of this embodiment, curves (a), (b), (c), and (A), (B), (C) being for the N=1000, 1500, 2000 rpm respectively. For example, when N=1000 rpm, in spite of the identical effective suction areas, in the true circular shaped cylinder, the vane chamber pressure $P_a$ has not reached the supply pressure $P_s$ at the time of $\theta=\theta_{s1}=225°$, and there is a pressure loss of about $\Delta P=0.1$ kg/$cm^2$. In this embodiment, the vane chamber pressure $P_a$ has reached the supply pressure $P_s$ at $\theta=210°$.

Thus, in the present invention, even if identical effective suction areas are used, the total weight of refrigerant can be improved by selection of the proper volume curve of the vane chamber, which is achieved by proper selection of the cylinder shape.

Figure 25:
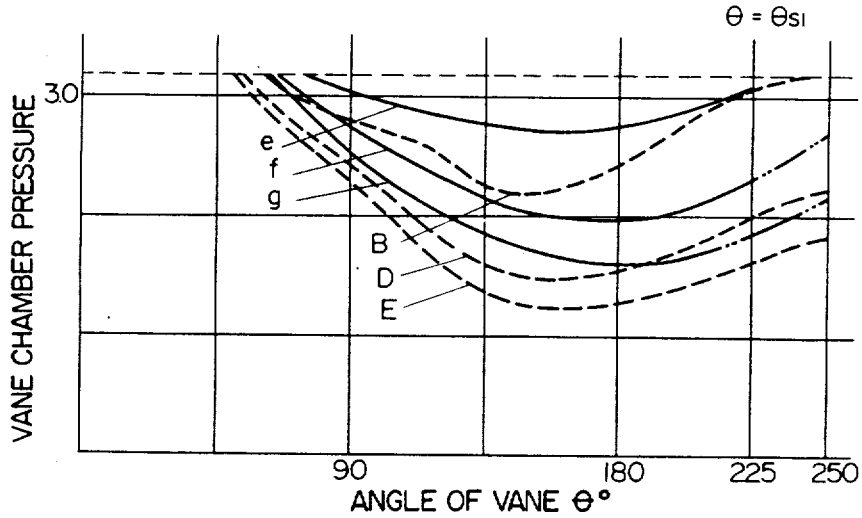

FIG. 25 shows a comparison between a compressor on which the suction area having a true circular shape is increased to $a_1=a_2=0.3$ cm$^2$, and a compressor according to this embodiment in which $a_1=a_2=0.2$ cm$^2$. The solid lines e, f, g show the characteristics of vane chamber pressure for the true circular shaped cylinder, and the chain lines B, D, F show the characteristics for this embodiment, the curves being for N=1500, 3000, 4000 rpm respectively. At N=1500 rpm, in spite of the fact that the pressure loss is nearly equivalent to e.g. $\theta=\theta_{s1}$, it will be seen that the pressure drop in this embodiment increases more gradually compared with that of a true circular shaped cylinder when the speed of rotation becomes high. Thus, in the compressor of the present invention, while maintaining nearly equivalent pressure loss at low speed, a large pressure drop as compared with that of a conventional compressor is produced at high speed.

Figure 26:
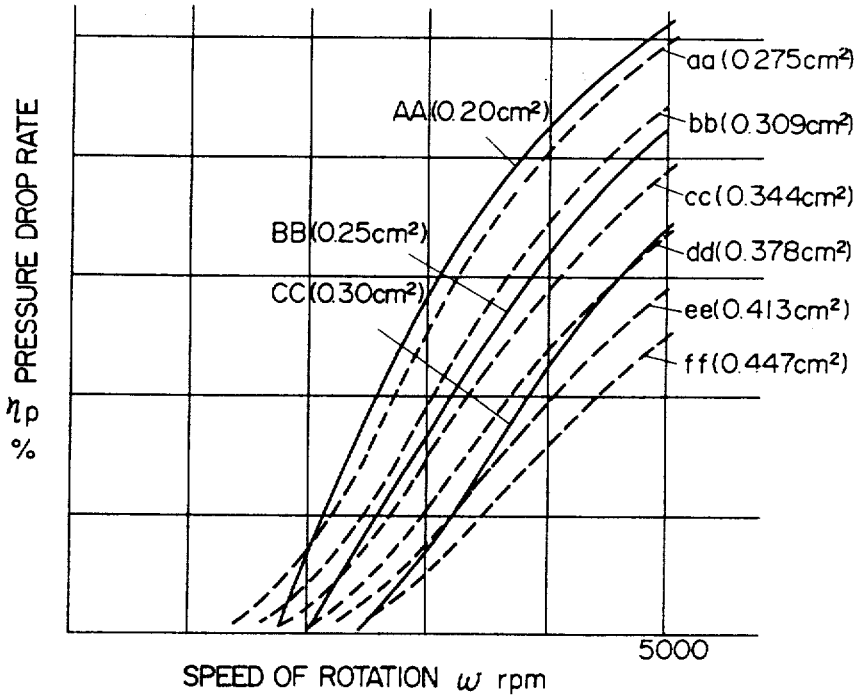
FIG. 26 is a graph showing the pressure drop rate relative to the speed of rotation.

FIG. 26 shows the pressure drop rate relative to the speed of rotation for various effective suction areas obtained in a compressor according to this embodiment, and in a conventional true circular cylinder compressor.

In this figure, solid lines (aa–ff) show the characteristics for the true circular shaped cylinder.

For the present FIG. 19 embodiment, it can be seen that gradient $\eta_p/\omega$ of pressure drop rate relative to the speed of rotation is large, and that said gradient becomes steeper, especially at a point near the speed of rotation where compressibility control is started.

For example, comparing this embodiment (BB) and a case of conventional cylinder (dd), it will be seen that although the pressure drop rate $\eta_p$ at low speed $\omega=2000$ rpm is equivalent, when they reach $\omega=4000$ rpm, a difference of more than 10% is produced in said $\eta_p$.

In the FIG. 19 embodiment, refrigerant was supplied into the vane chamber until it reached $\theta_{s2}=250°$, fully utilizing the flat part of the volume curve, but the supply of refrigerant can be interrupted nearly at $\theta_{s1}=225°$ as is customary.

This embodiment can be used by a compressor which has a nearly elliptic shaped cylinder, with the rotor arranged at its center.

In this kind of compressor, there are many cases where the shape of the cylinder is e.g. a function of $\sin 2\theta$, and in order to apply the present invention, the cylinder shape should be selected so that the varying rate of volume curve near the finish of the suction stroke becomes smaller compared with that of a conventional compressor similar to the present FIG. 19 embodiment, and it is more preferable if it can be made to have a rough flat part.

Figure 27:
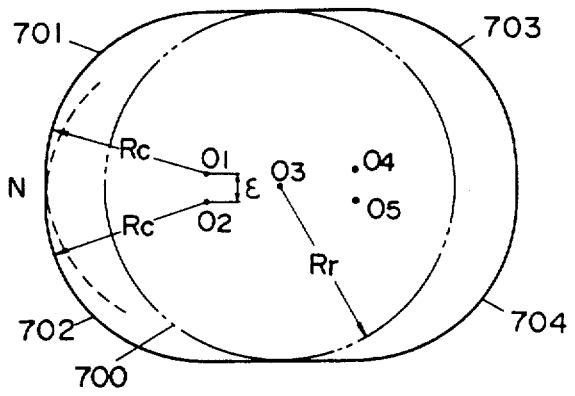
FIG. 27 is a section showing the cylinder shape of another embodiment of the present invention.

FIG. 27 shows one example. In the figure, 700 designates a rotor circle around center $\theta_3$ with a radius Rr, and 701, 702, 703, 704 are cylinder circles around centers $O_1$, $O_2$, $O_4$, $O_5$, respectively, and all with radius $R_c$.

The distance $\epsilon$ between centers $O_1$ and $O_2$, or $O_4$ and $O_5$ is small compared with dimensions such as Rr, Rc, and also other curves may be used sufficiently far from the crossing point N of the two circles considering the traveling stability of vane, etc.

Figure 28:
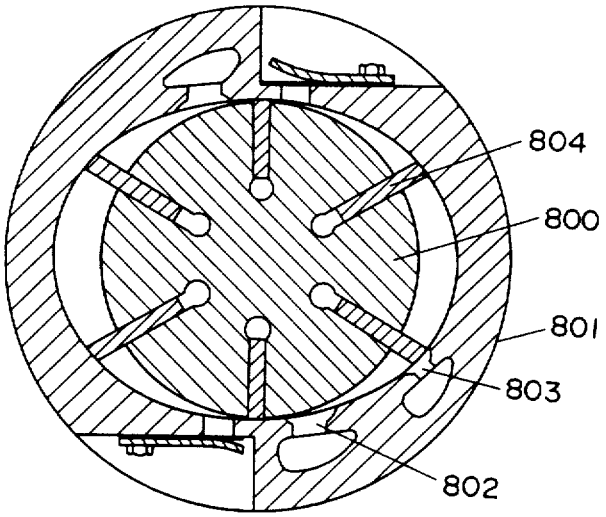
FIG. 28 is a front sectional view of a compressor according to another embodiment of the present invention.

FIG. 28 shows the manner of providing suction ports when the present invention is used in a compressor having a rough elliptic shaped cylinder.

In the figure 800 designates a rotor, 301 a cylinder, 802 a suction port, 803 a suction port, and 804 are vanes.

The term "effective suction area" means the following;

A rough value of effective suction area (a) can be obtained from a value corresponding to the minimum sectional area of fluid flow from outlet of the evaporator to the vane chamber of the compressor multiplied by the value of the contracting factor C=0.7=0.9. But, strictly speaking, the value gained from the following experiment which is performed in accordance with a method used in Japanese Industrial Standard B8320 etc. is defined as the effective suction area (a).

Figure 29:
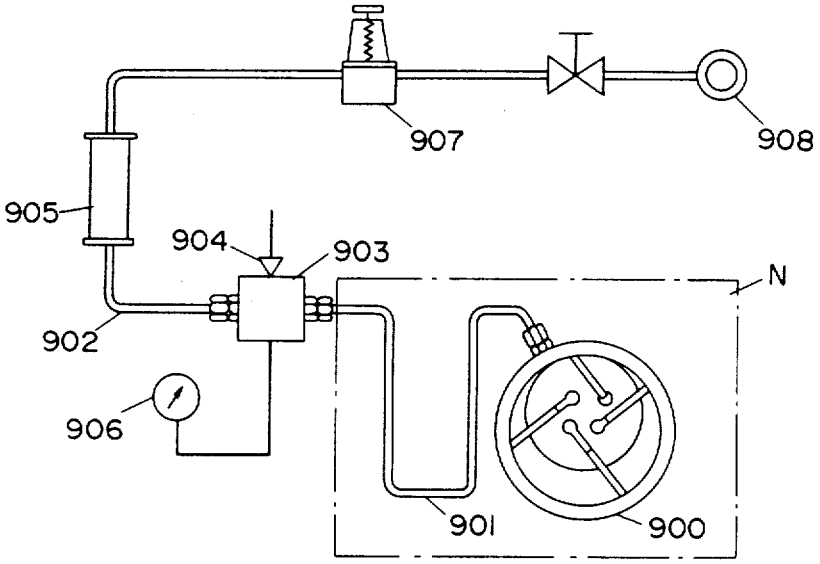
FIG. 29 is a schematic drawing of a practical apparatus for measuring effective suction area.

FIG. 29 shows one example of the apparatus for this experimental method, and in the figure, 900 designates a compressor, 901 a pipe connecting the suction port of the compressor with an evaporator when the compressor is mounted in a vehicle, 902 a high pressure air supplying pipe, 903 a housing to connect said both pipes 901 and 902, 904 a thermocouple, 905 a flow meter, 906 a pressure gauge, and 908 is a high pressure air source.

In FIG. 29, the portion enclosed by the one dot chain line (N) corresponds to a compressor according to this invention. However, in said experimental apparatus, if throttle action which cannot be ignored because fluid flow resistance exists in an evaporator, is to be taken into account, a throttle to simulate such resistance must be added to said pipe 901.

Taking the pressure of the high pressure air source as $P_1$ kg/cm$^2$abs., atmospheric pressure as $P_2=1.03$ kg/cm$^2$abs., the specific heat ratio of air as $k_1=1.4$, the specific weight as $\gamma 1$, gravitational acceleration as $g=980$ cm/sec$^2$, and the flowrate in weight to be gained under said condition as $G_1$, the effective suction area (a) can be obtained from the following formula:

$$a = G_1 / \sqrt{2g\gamma_1 P_1 \frac{\kappa_1}{\kappa_1 - 1}\left\{\left(\frac{P_2}{P_1}\right)^{\frac{2}{\kappa 1}} - \left(\frac{P_2}{P_1}\right)^{\frac{\kappa 1+1}{\kappa 1}}\right\}} \quad (20)$$

Figure 3A:
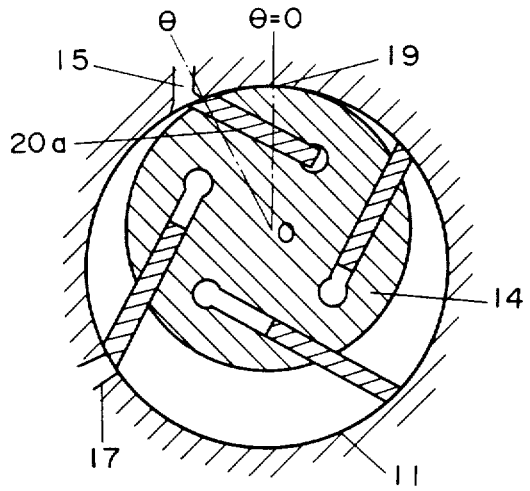
FIGS. 3(*a*)–(*e*) are explanatory drawings showing the state of flow of refrigerant into each vane chamber during the suction stroke.
Figure 3B:
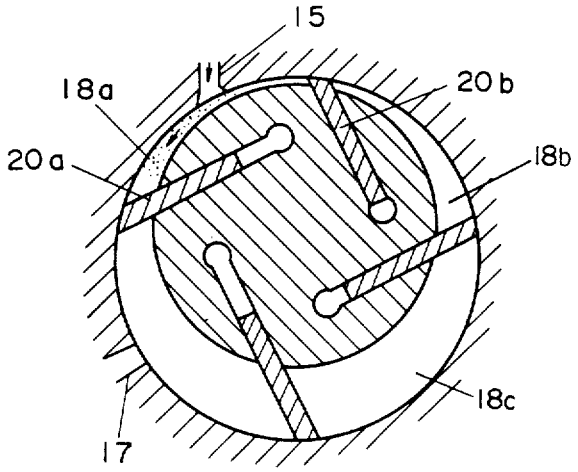
Figure 3C:
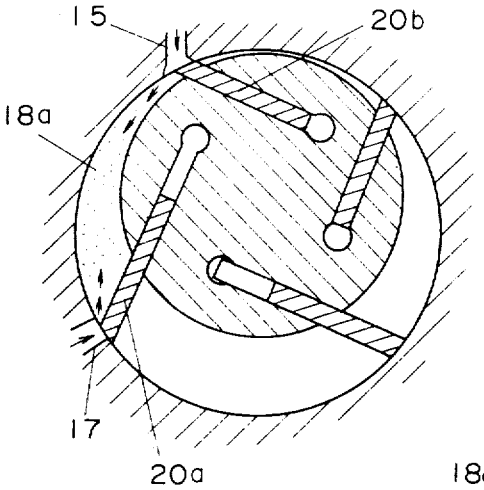
Figure 3D:
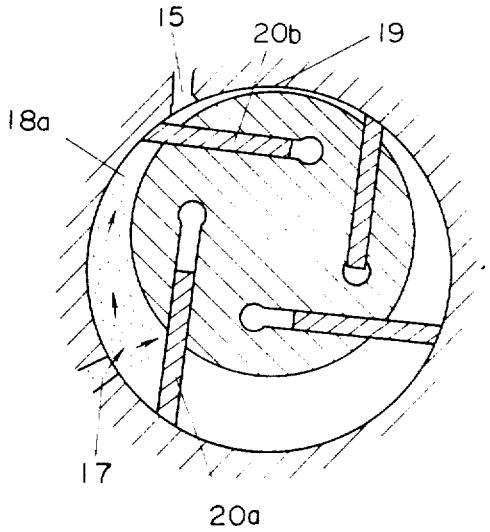
Figure 3E:
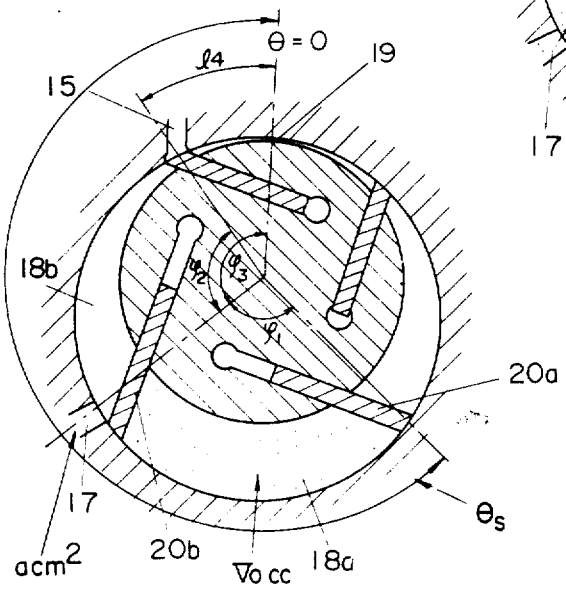

$P_2/P_1$ is within the range of $0.528<P_2/P_1<0.9$. The relative position of suction port 15 and suction port 17 will be described in an example of a compressor in which the shape of the inner face of cylinder 11 is a true circle as shown in FIG. 2. In connection with the experimental apparatus the number of circular spaces in the cylinder chamber formed between cylinder 11 and rotor 14 will be called lobe numbers m. Thus, for the compressor shown in FIG. 2, the lobe number is m=1, and for the shape of the cylinder which is an ellipse as shown in FIG. 19, the lobe number is m=2. In FIG. 3e, the number of vanes is n, the angle $\psi_1$ between the vanes is $\psi_1=360°/n$.

$\psi_2$ is also the angle between suction port 15 and suction port 17. When the inside shape is a true circle (or nearly a true circle), the angle $\psi_3$ from the top portion of cylinder 11 is $\psi_3=180°-180°/n$, and generally $\psi_3=180°/m-180°/n$.

Since suction port 15 cannot be formed at the position of top portion ($\theta=0$) of cylinder 11, in order to insure an effective suction area, the angle from the top portion 19 must be at least 20°. Accordingly, the maximum value which can be occupied by $\psi_2$ is $\psi_{2max}=\psi_3-20°=180°/n-180°/n-20°$.

The effect of the present invention is achieved by providing a traveling section (i.e. section $\psi_2$) in which refrigerant is supplied independently to each vane chamber from each suction port at a time just before finishing of the suction stroke, and it is better if said $\psi_2$ is larger, but practically, if it is $\psi_2 < \psi_{2\text{-}max}/2 = (180°/m - 180°/n - 20°)$, sufficient effect can be achieved.

Industrial Applicability

As described above, in the present invention refrigerant is supplied into the vane chamber from at least two ports during the suction stroke, and since an increase in volume efficiency can be intended during low speed rotation, it can be applied also to a compressor in which compressibility control is unnecessary e.g. constant speed type compressor, and thus the effect is remarkable.

What is claimed is:

1. A vane type rotary compressor comprising:

a cylinder casing constituted by a cylinder having a hollow interior and side plates closing the ends of said cylinder to define a rotor chamber in said hollow interior;

a rotor rotatably mounted in said rotor chamber eccentrically of the axis thereof;

a plurality of vanes slidably mounted on said rotor for sliding outwardly of said rotor into sliding engagement with the interior of said hollow interior during rotation of said rotor and defining vane chambers between said vanes, said rotor and said cylinder which increase and then decrease in size during rotation of said rotor;

said casing having at least two suction ports therein opening into said vane chambers, said ports being spaced around said hollow interior in the direction of rotation of said rotor substantially equally to the circumferential spacing of said adjacent vanes;

said compressor having the parameter K2 with the value $0.025 < K2 < 0.080$, wherein:

$K2 = a\theta_s/V_o$ a = effective flow area of the suction port toward the compression direction $\theta_s$ = the angle through which the end of a vane has rotated from the top of said casing to the end of a suction stroke $V_o$ = maximum volume of a vane chamber.

2. A compressor as claimed in claim 1 in which there are four vanes and two suction ports.

3. A compressor as claimed in claim 1 in which said casing has a circular cross-sectional shape.

4. A compressor as claimed in claim 1 in which said casing has an oval cross-sectional shape constituted by two circular portions the centers of which are spaced from each other.

5. A compressor as claimed in claim 1 in which the first of said suction ports has a groove in the inner surface of said cylinder extending in the direction of rotation and said rotor, and the downstream end of said groove is spaced from the second port a distance equal to the circumferential spacing of the adjacent vanes.

* * * * *